US009280130B2

(12) United States Patent
Kubota et al.

(10) Patent No.: US 9,280,130 B2
(45) Date of Patent: Mar. 8, 2016

(54) DEVELOPER CONTAINER, DEVELOPING DEVICE, PROCESS UNIT, AND IMAGE FORMING APPARATUS

(71) Applicants: Tomohiro Kubota, Osaka (JP); Naoki Nakatake, Hyogo (JP); Yoshiyuki Shimizu, Osaka (JP); Shoh Tsuritani, Osaka (JP); Manabu Hamada, Osaka (JP); Masato Tsuji, Osaka (JP); Masanari Fujita, Osaka (JP)

(72) Inventors: Tomohiro Kubota, Osaka (JP); Naoki Nakatake, Hyogo (JP); Yoshiyuki Shimizu, Osaka (JP); Shoh Tsuritani, Osaka (JP); Manabu Hamada, Osaka (JP); Masato Tsuji, Osaka (JP); Masanari Fujita, Osaka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/857,520

(22) Filed: Sep. 17, 2015

(65) Prior Publication Data

US 2016/0004208 A1 Jan. 7, 2016

Related U.S. Application Data

(63) Continuation of application No. 14/303,071, filed on Jun. 12, 2014, now Pat. No. 9,176,419, which is a continuation of application No. 13/908,434, filed on Jun. 3, 2013, now Pat. No. 8,792,808, which is a continuation of application No. PCT/JP2012/069783, filed on Jul. 27, 2012.

(30) Foreign Application Priority Data

Jul. 27, 2011 (JP) ..... 2011-164036
Feb. 1, 2012 (JP) ..... 2012-019937
Feb. 1, 2012 (JP) ..... 2012-019940

(51) Int. Cl.
*G03G 15/08* (2006.01)
*G03G 21/16* (2006.01)

(52) U.S. Cl.
CPC ..... *G03G 21/1647* (2013.01)

(58) Field of Classification Search
CPC ..... G03G 21/1647
USPC ..... 399/119
See application file for complete search history.

(56) References Cited

U.S. PATENT DOCUMENTS 5,276,479 A 1/1994 Inomata
5,909,610 A 6/1999 Yoshiki et al.

(Continued)

FOREIGN PATENT DOCUMENTS

EP 1 840 671 A1 10/2007
JP 04-247467 9/1992

(Continued)

OTHER PUBLICATIONS

International Search Report Issued Sep. 4, 2012 in PCT/JP2012/069783 Filed on Jul. 27, 2012.

(Continued)

*Primary Examiner* — Susan Lee
(74) *Attorney, Agent, or Firm* — Oblon, McClelland, Maier & Neustadt, L.L.P.

(57) ABSTRACT

The developer container includes a rotator that is rotated in the container body, a sequence of gears disposed outside the developer container that transmits a torque to the rotator, and a container guiding portion that fits with a main body side guiding portion and guides the developer container in a direction in which the developer container is attached to a mounting portion of an image forming device main body. A first gear included in the sequence of the gears is movable between an operating position where the first gear engages with a second gear and a retracted position where the first gear is retracted. On a surface on which the container guiding portion is disposed, a part of the container guiding portion is disposed within a projected area of the first gear being disposed at the operating position.

26 Claims, 24 Drawing Sheets

(56) References Cited

U.S. PATENT DOCUMENTS

| | | | | |
|---|---|---|---|---|
| 5,915,155 | A | 6/1999 | Shoji et al. | |
| 7,738,817 | B2 | 6/2010 | Sasae et al. | |
| 7,979,013 | B2 | 7/2011 | Yoshida et al. | |
| 8,019,254 | B2 | 9/2011 | Tatsumi et al. | |
| 8,135,329 | B2 | 3/2012 | Shimizu et al. | |
| 8,160,476 | B2 | 4/2012 | Shimizu et al. | |
| 8,626,025 | B2 * | 1/2014 | Kikuchi | G03G 21/12 399/110 |
| 2005/0226656 | A1 | 10/2005 | Tsuda et al. | |
| 2006/0104673 | A1 | 5/2006 | Sasae et al. | |
| 2007/0077097 | A1 | 4/2007 | Watanabe et al. | |
| 2008/0124133 | A1 | 5/2008 | Yoshizawa et al. | |
| 2008/0219698 | A1 | 9/2008 | Shimizu et al. | |
| 2008/0317509 | A1 | 12/2008 | Mori | |
| 2010/0129101 | A1 | 5/2010 | Muto | |
| 2010/0239312 | A1 | 9/2010 | Kikuchi et al. | |
| 2011/0052255 | A1 | 3/2011 | Yoshida et al. | |
| 2011/0064473 | A1 | 3/2011 | Fujita et al. | |
| 2012/0114373 | A1 | 5/2012 | Hamada et al. | |
| 2012/0189327 | A1 | 7/2012 | Kubota et al. | |

FOREIGN PATENT DOCUMENTS

| | | |
|---|---|---|
| JP | 08-062966 | 3/1996 |
| JP | 9-43959 | 2/1997 |
| JP | 09-106157 | 4/1997 |
| JP | 10-069160 | 3/1998 |
| JP | 10-247009 | 9/1998 |
| JP | 2003-057947 | 2/2003 |
| JP | 2004-139031 | 5/2004 |
| JP | 2006-139069 | 6/2006 |
| JP | 2006-139070 | 6/2006 |
| JP | 2006-163143 | 6/2006 |
| JP | 2007-271943 | 10/2007 |
| JP | 2008-033192 | 2/2008 |
| JP | 2008-134571 | 6/2008 |
| JP | 2008-261968 | 10/2008 |
| JP | 2008-298907 | 12/2008 |
| JP | 2009-042567 | 2/2009 |
| JP | 4283070 | 6/2009 |
| JP | 2010-145618 | 7/2010 |
| JP | 3162418 U | 9/2010 |
| JP | 2010-276955 | 12/2010 |
| JP | 2012-003142 | 1/2012 |

OTHER PUBLICATIONS

Japanese Office Action Dated Nov. 13, 2012 for related Japanese Application No. 2012-019937.

Japanese Office Action Dated Jan. 18, 2013 for related Japanese Application No. 2012-019937.

Japanese Office Action Dated Nov. 13, 2012 for related Japanese Application No. 2012-019940.

Extended European Search Report mailed Nov. 27, 2013, in European Patent Application No. 12817822.5.

Extended European Search Report issued Jun. 5, 2015 in Patent Application No. 15154246.1.

* cited by examiner 50
58
73b
73
63
100
111
104
101
52
60
72
64
71
62
79
71b
103
102
49
105
106

DEVELOPER CONTAINER, DEVELOPING DEVICE, PROCESS UNIT, AND IMAGE FORMING APPARATUS

CROSS-REFERENCE TO RELATED APPLICATIONS

This application is a continuation application of U.S. application Ser. No. 14/303,071, filed Jun. 12, 2014, which is a continuation application of U.S. application Ser. No. 13/908,434, filed Jun. 3, 2013, (now U.S. Pat. No. 8,792,808), which is a U.S. continuation application filed under 35 USC 111a and 365c of PCT application JP2012/069783, filed on Jul. 27, 2012, which claims priority to Japanese Application No. 2011-164036, filed Jul. 27, 2011, Japanese Application No. 2012-019940, filed Feb. 1, 2012, and Japanese Application No. 2012-019937, filed in Japan on Feb. 1, 2012. The entire contents of the above-identified applications are incorporated herein by reference.

TECHNICAL FIELD

Embodiments of the present invention relate to a developer container that contains developer, a developing device, a process unit, and an image forming apparatus that include the developer container.

BACKGROUND ART

For an image forming apparatus, such as a copier, a printer, a facsimile, and a compound machine thereof, a scheme has been known such that, for example, a developing device, a charging device, and a photoconductor are integrally formed as an image forming unit, and the image forming unit is detachably attached to the image forming apparatus. Such a scheme has been adopted for many products because of its advantage that maintenance of the apparatus can be easily performed by replacing the unit with another one by a user. Types of such an image forming unit include an image forming unit where a developer container for containing developer, such as toner, is integrally formed with the image forming unit, and an image forming unit where a developer container is separately formed from the image forming unit.

For the case of the former, when the stored developer runs out, the image forming unit is replaced with a new unit. This case is advantageous in that the developing device and the photoconductor can be replaced together with the used developer container, and thereby easing the replacement tasks.

On the other hand, for the case of the latter, when the stored developer runs out, only the developer container is replaced with a new one. In this case, the developing device and the photoconductor can be continuously used without being replaced, provided that their longevities have not been reached. Backed by an increasing interest in consideration of environmental impact, the configuration where the developer container can separately be replaced is becoming the mainstream.

In the configuration where the developer container is separately attached and detached, it may be required to position a position of a discharge opening of the developer container with a position of a supply opening of the developing device. Therefore, in general, a guide unit for guiding the developer container during attaching or detaching the developer container and a positioning portion for positioning the developer container with respect to the main body of the image forming apparatus are provided on the exterior surface of the developer container.

Further, there is a developer container that includes a conveyance screw for conveying the developer inside the developer container and an agitator for agitating the developer. In such a developer container, a driving force to the conveyance screw and the agitator is generally obtained from a driving source disposed in the main body of the image forming apparatus. Therefore, gears are provided on the exterior of such type of a developer container, so as to transfer the driving force from the driving source in the main body of the image forming apparatus to the conveyance screw and the agitator (cf., Patent Document 1 (Japanese Registered Patent No. 4283070) and Patent Document 2 (Japanese Patent Laid-Open Application No. 2006-139069)).

When the gears are provided on the exterior of the developer container as described above, it may be required to prevent the guide unit for guiding the developer container during attaching or detaching of the developer container from interfering with the gears. Therefore, there is a restriction on the layout that the guide unit attached to the developer container is placed at a position that is separated from a position where the gears are provided. In this case, the size of the developer container becomes large accordingly. Therefore, there is a problem that it is difficult to downsize the device.

In view of the above problem, an object of the present invention is to provide a developer container that improves a degree of freedom in designing a layout of a guide unit that can be downsized, and a developing device, a process unit, and an image forming apparatus that include the developer container.

SUMMARY OF THE INVENTION

Means for Solving the Problems

In one aspect, there is provided a developer container configured to be detachably attached to an image forming apparatus main body. The developer container includes a container body configured to store developer; a discharge opening configured to discharge the developer inside the container body; a rotator configured to be rotationally driven in the container body; a sequence of gears disposed on an external side of the container body, the sequence of gears including plural gears configured to transmit a driving torque to the rotator; and a container guiding portion configured to guide the developer container toward the image forming apparatus in a direction in which the developer container is attached to the image forming apparatus, wherein the container guiding portion guides the developer container by fitting with a main body side guiding portion disposed in the image forming apparatus. A first gear included in the sequence of gears is configured to be moved between an operating position where the first gear engages with a second gear and transmits a torque and a retracted position where the first gear is retracted from the operating position. On a surface on which the container guide portion is disposed, apart of the container guide portion or all the container guide portion is configured to be disposed within a projected area of the first gear being disposed at the operating position.

In the above configuration, a gear in the sequence of the gears is movable between the operating position and the retracted position. Therefore, even if the part of or all the guide portion at the developer container is disposed within the projection area of the gear placed at the operating position, the main body side guiding portion at the image forming apparatus main body can be prevented from interfering with the sequence of the gears during attaching or detaching of the developer container. Further, according to the present invention, since the degree of freedom on designing the layout of the container guide portion at the developer container is improved, the developer container can be downsized.

DESCRIPTION OF THE REFERENCE NUMERALS

Figure 1:
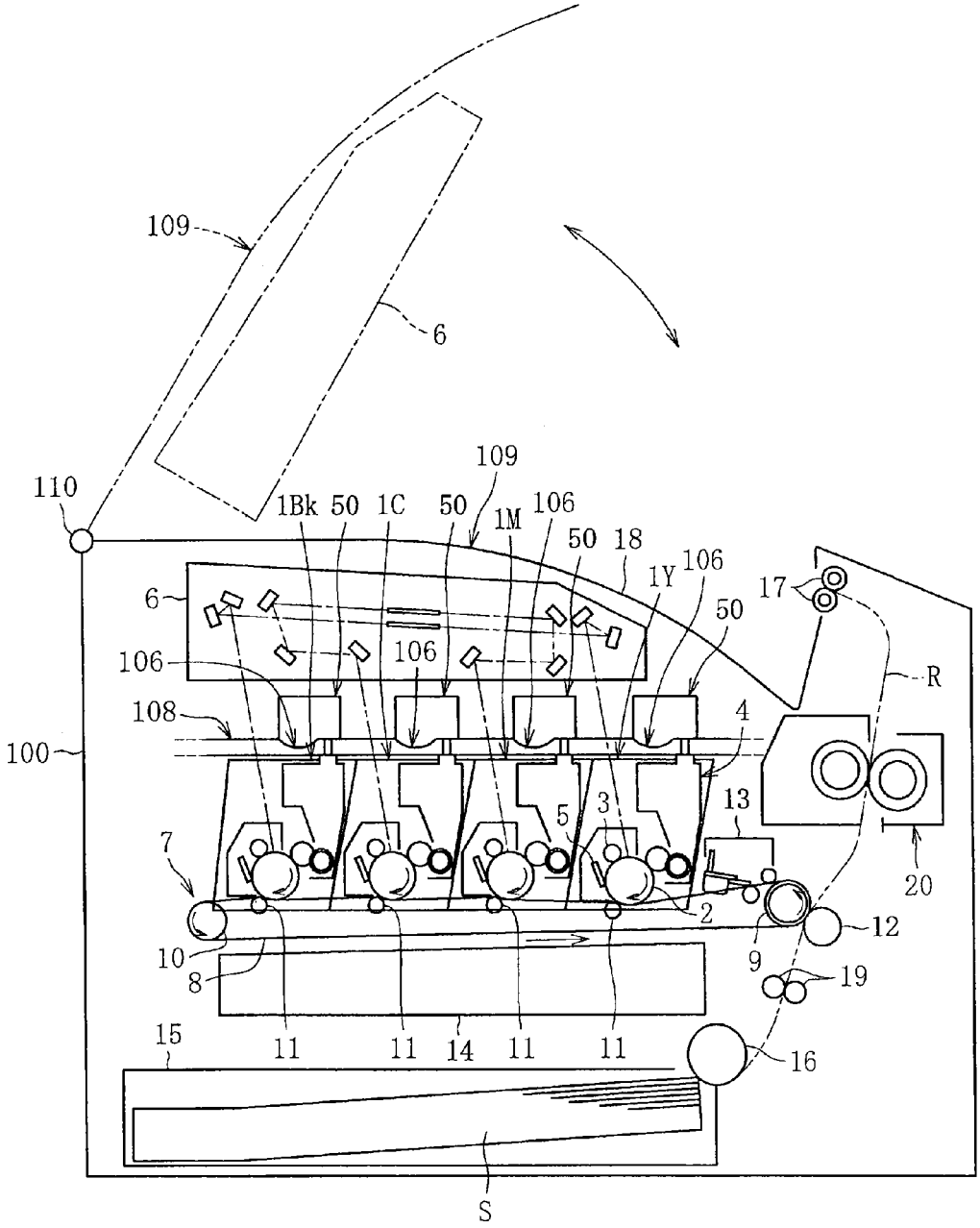
FIG. 1 is a schematic configuration diagram of an image forming apparatus according to an embodiment of the present invention.

1Y, 1M, 1C, 1Bk Process units
2 Photoconductor (latent image supporting body)
4 Developing device
22 Internal shutter
23 Inner opening
24 Return opening
26 Tension spring (biasing member)
27 Internal shutter protrusion
40 Developer housing
41 Developing roller (developer supporting body)
49 Supply opening
50 Toner cartridge (developer container)
53 Conveyance screw (conveyor)
54 Agitator
60 External shutter
62 Conveyance drive gear (driving force transmitter)
63 Agitating drive gear (second driving force transmitter)
65 Roof portion
66 Toner conveyance passage (developer conveyance passage)
67 Second return opening
70 Container body
71*b* Gear holder protrusion (pushed portion)
100 Image forming apparatus main body
101 Protrusion or horizontal protrusion (main body side guiding portion)
102 Apparatus main body protrusion (a main body side pushing portion)
109 Upper cover (first cover)
113 Moving member
116 Internal cover (second cover)
120 Container mounting portion
130 Unit mounting portion
200 Agitation region
K1 Width of inner opening
K2 Width of discharge opening
K3 Width of supply opening

MODE FOR CARRYING OUT THE INVENTION

Hereinafter, embodiments of the present invention are explained based on the accompanying figures. In the figures for illustrating the embodiments, the same reference numerals are attached to members or components having the same functions or the same shapes, as long as they can be identified. By attaching the same reference numerals, once the member or the component is explained, duplicated explanations for the members or the components having the same reference numerals are omitted.

First Embodiment

Hereinafter, an overall configuration and operations of a color laser printer according to a first embodiment of the present invention are explained by referring to FIG. 1. However, the embodiment of the present invention is not limited to this. The configuration according to the embodiment may be applied to a monochrome printer, other printers, a copier, a facsimile machine, and an image forming apparatus that is a combined machine thereof.

As shown in FIG. 1, four process units 1Y, 1M, 1C, and 1Bk are detachably attached to an apparatus main body of the color laser printer (image forming apparatus main body) 100 as image forming units. The process units 1Y, 1M, 1C, and 1Bk has the same configurations, except that the process unit 1Y stores yellow (Y) toner, the process unit 1M stores magenta (M) toner, the process unit 1C stores cyan (C) toner, and the process unit 1Bk stores black (Bk) toner. The different colors of yellow, magenta, cyan, and black correspond to color decomposition components of a color image.

Specifically, each of the process units 1Y, 1M, 1C, and 1Bk includes, at least, a photoconductor 2 having a drum-like shape as a latent image supporting body; a charging device including a charging roller 3 for electrically charging a surface of the photoconductor 2; a developing device 4 that supplies the toner to a latent image on the photoconductor 2; and a cleaning device including a cleaning blade 5 for cleaning the surface of the photoconductor 2. In FIG. 1, the reference numerals are only attached to the photoconductor 2, the charging roller 3, the developing device 4, and the cleaning blade 5 included in the yellow process unit 1Y. In other process units 1M, 1C, and 1Bk, the reference numerals are omitted. Further, in the first embodiment, single-component developer formed of toner particles is utilized as the developer. However, the developer is not limited to this, and the developer may be dual-component developer formed of the toner particles and carrier particles.

Above the four developing devices 4 included in the process units 1Y, 1M, 1C, and 1Bk, respectively, corresponding four toner cartridges 50 are disposed. The four toner cartridges 50 are utilized as developer containers that store the corresponding four colors of toner to be supplied to the corresponding four developing devices 4. In the first embodiment, a partition board 108 included in the apparatus main body 100 is disposed between the four developing devices 4 and the corresponding four toner cartridges 50. The four toner cartridges 50 are detachably attached to four mounting portions 106 formed in the partition board 108.

In the upper vicinity of the toner cartridges 50, an exposure unit 6 is disposed. The exposure unit 6 irradiates the surfaces of the photoconductors 2 included in the corresponding process units 1Y, 1M, 1C, and 1Bk. The exposure unit 6 includes, at least, a light source, a polygon mirror, an f-theta lens, and a reflecting mirror. The exposure unit 6 irradiates laser beams onto the surfaces of the corresponding photoconductors 2 based on image data.

An upper cover 109 is provided at an upper portion of the apparatus main body 100. The upper cover 109 is openable and closable in the vertical direction as the upper cover 109 is pivoted around a fulcrum 110. The above-described exposure unit 6 is attached to the upper cover 109. Therefore, when the upper cover 109 is opened, the exposure unit 6 can be retracted from the upper vicinity of the toner cartridges 50. In this state, the toner cartridges 50 can be attached to and detached from the apparatus main body 100 through an upper opening.

A transfer unit 7 is disposed below the process units 1Y, 1M, 1C, and 1Bk. The process unit 7 includes an intermediate transfer belt 8 that acts as a transfer body. The intermediate transfer belt 8 is formed of an endless belt. The intermediate transfer belt 8 is suspended around a driving roller 9 and a driven roller 10, which act as supporting body members. As the driving roller 9 rotates in the counterclockwise direction in the figure, the intermediate transfer belt 8 circulates (rotates) in the direction indicated by the arrow in the figure.

Four primary transfer rollers 11 are disposed at positions facing the corresponding four photoconductors 2. The primary transfer rollers 11 are pressing an inner circumferential surface of the intermediate transfer belt 8 at the corresponding positions. Primary transfer nips are formed at the portions where the pressed portions of the intermediate transfer belt 8 and the corresponding photoconductors 2 contact each other. The primary transfer rollers 11 are connected to a power supply (not shown), and predetermined direct-current voltages (DC) and/or alternating-current voltages (AC) are applied to the corresponding primary transfer rollers 11.

A secondary transfer roller 12 is disposed at a position facing the driving roller 9 as a secondary transfer unit. The secondary transfer roller 12 is pressing an outer circumferential surface of the intermediate transfer belt 8. A secondary transfer nip is formed at a portion where the secondary transfer roller 12 contacts the intermediate transfer belt 8. Similar to the primary transfer rollers 11, the secondary transfer roller 12 is connected to the power supply (not shown), and a predetermined direct-current voltage (DC) and/or alternating-current voltage (AC) is applied to the secondary transfer roller 12.

A belt cleaning unit 13 is disposed on the outer circumferential surface of the intermediate transfer belt 8 at the rightmost side. A waste toner transfer hose (not shown) extending from the belt cleaning unit 13 is connected to an inlet opening of a waste toner container 14 disposed below the transfer unit 7.

A paper feed cassette 15 is disposed at a lower portion of the apparatus main body 100. The paper feed cassette 15 stores recording media S such as sheets of paper or OHP sheets. The paper feed cassette 15 includes a paper feed roller 16 that sends out the recording media S stored in the paper feed cassette 15. On the other hand, a pair of paper discharge rollers 17 for discharging the recording media to the outside is disposed at an upper portion of the apparatus main body 100. Additionally, a paper discharge tray 18 for stocking the recording media discharged by the paper discharge rollers 17 is disposed on the upper cover 109.

A conveyance path R is provided in the apparatus main body 100. The conveyance path R is for conveying the recording media S from the paper feed cassette 15 to the paper discharge tray 18 through the secondary transfer nip. In the conveyance path R, a pair of registration rollers 19 is disposed at an upstream side of the position of the secondary transfer roller 12 in the recording medium conveyance direction. The pair of registration rollers 19 is a conveyance unit for conveying the recording medium while adjusting the conveyance timing. Further, a fixing unit 20 is disposed at a downstream side of the position of the secondary transfer roller 12 in the recording medium transfer direction.

The above-described image forming apparatus operates as follows. Namely, when the image forming operation is started, the photoconductors 2 of the corresponding process units 1Y, 1M, 1C, and 1Bk are rotationally driven in the clockwise direction in FIG. 1, and the surfaces of the photoconductors 2 are uniformly charged in a predetermined polarity by the corresponding charging rollers 3. The exposure unit 6 irradiates laser beams onto the charged surfaces of the corresponding photoconductors 2 based on image information of a document read by an image reading unit (not shown), and thereby forming electrostatic latent images on the surfaces of the corresponding photoconductors 2. At this time, the image information exposed onto the corresponding photoconductor 2 is single-color image information corresponding to one of the yellow image information, the magenta image information, the cyan image information, and the black image information, which are formed by color decomposing the image information. When the toner is supplied to the electrostatic latent images formed on the photoconductors 2 by the corresponding developing devices 4, the electrostatic latent images are visualized as toner images.

Subsequently, the driving roller 9 suspending the intermediate transfer belt 8 is rotationally driven, and thereby causing the intermediate transfer belt 8 to be circulated in the direction of the arrow in the figure. Further, when constant voltages having the polarities opposite to the charging polarity of the toner are applied to the corresponding primary transfer rollers 11, or when voltages to which the constant-current control is applied and which have the polarities opposite to the charging polarity of the toner are applied to the corresponding primary transfer rollers 11, transfer electric fields are formed at the primary transfer nips between the primary transfer rollers 11 and the corresponding photoconductors 2. The toner images in the corresponding colors are sequentially superposed and transferred onto the intermediate transfer belt 8 by the transfer electric fields formed at the corresponding primary transfer nips. In this manner, the intermediate transfer belt 8 supports a full color toner image on its surface. Further, the toner that has not been transferred onto the intermediate transfer belt 8 and remaining on the corresponding photoconductors 2 is removed by the corresponding cleaning blades 5.

On the other hand, in the paper feed cassette 15, a stored recording medium S is sent out toward the conveyance path R by the rotation of the paper feed roller 16. After the recording medium S has been sent out toward the conveyance path R, the registration rollers 19 adjust the conveyance timing and send out the recording medium S to the secondary transfer nip between the secondary transfer roller 12 and the intermediate transfer belt 8. At this time, a transfer voltage having a polarity opposite to the toner charging polarity of the toner image on the intermediate transfer belt 8 is applied to the secondary transfer roller 12, and thereby forming a transfer electric field at the secondary transfer nip. Then the toner image on the intermediate transfer belt 8 is collectively transferred onto the recording medium S by the transfer electric field formed at the secondary transfer nip. Further, after the transfer of the image has been completed, the toner remaining on the intermediate transfer belt 8 is removed by the belt cleaning unit 13. The removed toner is conveyed to the waste toner container 14 and collected.

Subsequently, the recording medium S on which the toner image has been transferred is conveyed to the fixing unit 20, and the fixing unit 20 fixes the toner image onto the recording medium S. Then, the recording medium S is ejected outside the device by a pair of the paper discharge rollers 17, and stocked on the paper discharge tray 18.

The image forming operations for forming a full color image on a recording medium have been explained above. However, a single-color image may be formed by using any one of the four process units 1Y, 1M, 1C, and 1Bk. Similarly, a dual-color image or a triple-color image may be formed by using two or three process units.

Figure 2:
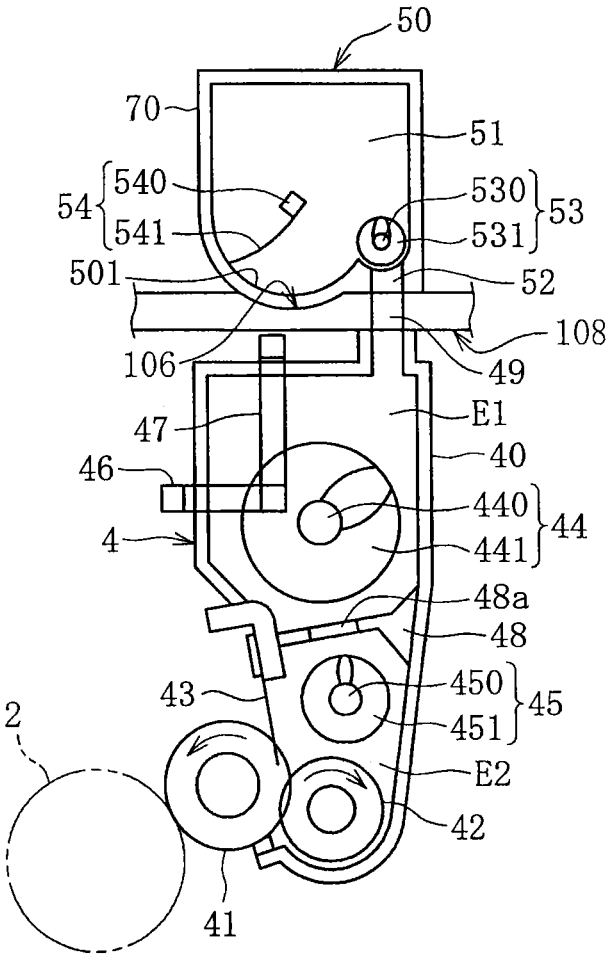
FIG. 2 is a schematic cross-sectional view of a developing device and a toner cartridge.

FIG. 2 is a schematic cross-sectional view of the above-described developing device and the above-described toner cartridge. As shown in FIG. 2, the developing device 4 includes, at least, a developer housing 40 for storing toner; a developing roller 41 that acts as a developer supporting body for supporting body toner; a supply roller 42 that acts as a developer supply member for supplying toner to the developing roller 41; a developing blade 43 that acts as a regulating member for regulating an amount of toner supported on the developing roller 41; two conveyance screws 44 and 45 that act as conveyors for conveying toner; and two light guide members.

An internal portion of the developer housing 40 is divided into a first region E1 corresponding to the upper side in the figure and a second region E2 corresponding to the lower side in the figure by a partition member 48. Communication openings 48*a* are provided at both end portions of the partition member 48 (the near side and the far side in the direction perpendicular to the paper surface of FIG. 2). Namely, the first region E1 and the second region E2 are connected at the portions where the corresponding two communication openings 48*a* are formed.

The conveyance screw 44 and the two light guide members 46 and 47 are included inside the first region E1. On the other hand, the conveyance screw 45 and the supply roller 42 are included inside the second region E2. Further, the developing roller 41 and the developing blade 43 are disposed at an opening of the second region E2 facing the photoconductor 2.

The conveyance screw 44 includes a rotational shaft 440. A spiral-shaped blade 441 is attached to an outer circumference of the rotational shaft 440. Similarly, the conveyance screw 45 includes a rotational shaft 450, and a spiral-shaped blade 451 is attached to an outer circumference of the rotational shaft 450. When the conveyance screws 44 and 45 rotate, the conveyance screws 44 and 45 convey toner along the directions of the corresponding shafts 440 and 450. The toner conveyance direction by the conveyance screw 44 and the toner conveyance direction by the conveyance screw 45 are opposite to each other.

The above-described developing roller 41 includes a shaft formed of a metal and an electrically-conductive rubber disposed around the shaft. In the first embodiment, the shaft has an outer diameter of 6 mm, the electrically-conductive rubber has an outer diameter of 12 mm and a rubber hardness Hs of 75. A volume resistivity value of the electrically-conductive rubber is adjusted to be within a range from about $10^5\Omega$ to $10^7\Omega$. As the electrically-conductive rubber, for example, an electrically-conductive urethane rubber and a silicone rubber may be used. The developing roller 41 rotates in the counter-clockwise direction in FIG. 2, and conveys the developer supported on its surface to the positions facing the developing blade 43 and the photoconductor 2.

As the supply roller 42, usually, a sponge roller is utilized. As a sponge roller, it is preferable to use a roller formed by adhering foamed polyurethane, which has been adjusted to be semi-conductive by mixing carbon, around a metal shaft. In the first embodiment, the shaft has an outer diameter of 6 mm, and the sponge portion has an outer diameter of 12 mm. The supply roller 42 contacts the developing roller 41. The nip portion formed by contacting the supply roller 42 to the developing roller 41 is usually adjusted to be within a range from about 1 mm to 3 mm. In the first embodiment, the nip is 2 mm. The supply roller 42 rotates in a direction opposite to the direction in which the developing roller 41 rotates (the clockwise direction in FIG. 2), and thereby the supply roller 42 efficiently supplies the toner inside the developer housing 40 to the surface layer of the developing roller 41. In the first embodiment, a fine toner supply function is ensured by setting a rotational speed ratio between the developing roller 41 and the supply roller 42 to be 1.

The developing blade 43 is, for example, a metal plate formed of stainless steel (SUS) or the like and having thickness of about 0.1 mm. The developing blade 43 contacts the surface of the developing roller 41 at its tip side. The control, by the developing blade 43, of the amount of the toner on the developing roller 41 can be regarded as a very important parameter for stabilizing the developing characteristic and for obtaining fine image quality. Therefore, in a usual product, the abutment pressure of the developing blade 43 with respect to the developing roller 41 is strictly adjusted to be within a range from 20 N/m to 60 N/m, and the position of the nip portion is strictly controlled to be 0.5 mm plus minus 0.5 mm from the tip of the developing blade 43. Here, these parameters are arbitrary determined depending on characteristics of the toner to be used, the developing roller, and the supply roller. In the first embodiment, the developing blade 43 is formed of a stainless steel (SUS) plate having thickness of 0.1 mm, the abutment pressure is set to be 45 N/m, the position of the nip portion is set to be 0.2 mm from the tip of the developing blade 43, and the length (free length) from the supported end to the free end (the tip) of the developing blade 43 is set to be 14 mm. In this manner a stable thin layer of the toner can be formed on the developing roller 41.

The two light guide members 46 and 47 are formed of a material having fine optical transparency. For example, when a resin is utilized as the material, it is preferable to use an acrylic material having a high degree of transparency or a polycarbonate (PC) resin material having a high degree of transparency. Additionally, optical glass may be utilized as a material of the light guide members 46 and 47. With the optical glass, a better optical characteristic can be obtained. Alternatively, optical fibers can be utilized as materials of the light guide members 46 and 47. When the optical fibers are utilized, the degree of freedom on designing optical paths formed of the light guide members 46 and 47 is improved.

One end portion of the light guide member 46 is exposed outside the developer housing 40. Similarly, one end portion of the light guide member 47 is exposed outside the developer housing 40. In a state where the process unit is attached to the image forming apparatus main body 100, a light emitting element (not shown) faces the exposed end portion of the light guide member 46. On the other hand, a light receiving element (not shown) faces the exposed end portion of the light guide member 47. The light emitting element and the light receiving element are attached to the main body side and function as a toner amount detection unit. In a state where the light emitting element and the light receiving element face the corresponding exposed end portions of the light guide members 46 and 47, a light path for guiding light from the light emitting element to the light receiving element through the light guide members 46 and 47 is formed. Namely, the light emitted from the light emitting element is guided inside the developer housing 40 through the light guide member 46, and subsequently the light is guided to the light receiving element through the light guide member 47. Further, in the developer housing 40, a predetermined space is provided between end portions of the light guide members 46 and 47 that face each other.

The toner cartridge 50 includes, at least, a container body 70 that includes therein a toner storing space 51 for storing toner; a discharge opening 52 for discharging the toner inside the container body 70; a conveyance screw 53 that functions as a conveyor for conveying the toner inside the container body 70 to the discharge opening 52; and an agitator 54 agitates the toner inside the toner storing space 51. The discharge opening 52 is disposed at a lower portion of the container body 70. On the other hand, a supply opening 49 is formed at corresponding mounting portion 106 of the partition board 108, to which the toner cartridge 50 is attached. The supply opening 49 is connected to the discharge opening 52.

The conveyance screw 53 is formed by attaching a spiral-shaped blade 531 around an outer circumference of a rotational shaft 530. The agitator 54 is formed by attaching a deformable blade 541 having a planer shape to a rotational shaft 540. The rotational shaft 540 is arranged in parallel with the rotational shaft 530 of the conveyance screw 53. The blade 541 of the agitator 54 is formed of a flexible material such as a PET film. Further, as shown in FIG. 2, by forming a bottom surface 501 of the container body 70 to be an arc shape along a rotational trajectory of the blade 541, an amount of the toner that is not moved by the blade 541 and remains inside the toner storing space 51 can be reduced.

In the first embodiment, the cartridge 50 can be individually attached to the apparatus main body 100. However, the configuration of the cartridge 50 is not limited to this configuration. For example, the toner cartridge 50 may integrally be formed together with the developing device 4 and the photoconductor 2 so that the toner cartridge 50 can be replaced as a process unit. Alternatively, the toner cartridge 50 may integrally be formed together with the developing device 4 so that the toner cartridge 50 can be replaced as a developing unit. In such a case, the toner cartridge 50 can be directly attached to an upper portion of the developing device 4, by removing the above-described partition board 108 and providing the mounting portion 106 at the upper portion of the developing device 4.

Developing operations of the above-described developing device are explained while referring to FIG. 2. When it is directed to start image forming operations and the developing roller 41 and the supply roller 42 start rotating, toner is supplied to the surface of the developing roller 41 by the supply roller 42. When the toner supported on the developing roller 41 passes through the nip portion between the developing roller 41 and the developing blade 43, thickness of the toner layer is regulated while the toner is frictionally charged. When the toner on the developing roller 41 is conveyed to the position facing the photoconductor 2 (developing area), the toner electrostatically transfers onto the photoconductor 2 and the toner image is formed.

Next, toner supplying operations for supplying the toner to the developing device are explained. The toner is supplied to the developing device, when the amount of the toner in the developer housing 40 becomes less than or equal to a predetermined reference value. Specifically, when the amount of the toner in the developer housing 40 is greater than the predetermined reference value, the toner exists at the space between the end portions of the two light guide members 46 and 47, where the light guide members 46 and 47 are facing each other. Thus, the light path between the end portions is blocked by the toner and the light does not reach the light receiving element. Subsequently, when the toner in the developer housing 40 is consumed and the amount of the toner becomes less than or equal to the predetermined reference value, the toner does not exist at the space between the end portions of the two light guide members 46 and 47 where the two light guide members 46 and 47 are facing each other, and the light passes through the space between the end portions. When the light that passes through the space between the end portions is detected, it is instructed to supply toner.

When it is instructed to supply the toner, the conveyance screw 53 in the toner cartridge 50 rotates. Then the toner is conveyed toward the discharge opening 52, and thereby the toner is supplied from the discharge opening 52 to the first region E1 in the developer housing 40. Further, in the first embodiment, when the conveyance screw 53 in the toner cartridge 50 starts rotating, the agitator 54 starts rotating at the same time. The toner inside the toner cartridge 50 is agitated and conveyed toward the conveyance screw 53 by the rotation of the agitator 54. After that, when the amount of the toner in the developer housing 40 becomes greater than the predetermined reference value by the supply of the toner (namely, when the light path between the two light guide members 46 and 47 is blocked by the toner), the rotational drivings of the conveyance screw 53 and the agitator 54 are stopped and the supply of the toner is terminated.

On the other hand, in the developer housing 40, when the toner is supplied, the conveyance screw 44 disposed in the first region E1 and the conveyance screw 45 disposed in the second region E2 rotate, and the toner is conveyed in the directions opposite to each other in the corresponding regions E1 and E2. The toner conveyed to an end portion in a downstream side in the toner conveyance direction in the region E1 is passed through the first communication opening 48*a* formed at the end portion of the partition member 48 and sent into the region E2. Similarly, the toner conveyed to an end portion in a downstream side in the toner conveyance direction in the region E2 is passed through the second communication opening 48*a*, which is the other communication opening 48*a* formed at the other end portion of the partition member 48, and sent into the region E1. The toner sent into the region E2 is conveyed by the conveyance screw 45 in the region E2, and the toner is passed through the second communication opening 48*a* and sent into the region E1. Similarly, the toner sent into the region E1 is conveyed by the conveyance screw 44 in the region E1, and the toner is passed through the first communication opening 48*a* and sent into the region E2. By repeating these operations, the toner circulates in the first region E1 and in the second region E2, and new toner that has been supplied is mixed with the toner that has already existed in the developer housing 40.

In this manner, in the first embodiment, the state of the toner (the ratio of the new toner in the toner) is homogenized, and a failure such as unevenness in color and greasing can be prevented from occurring.

Figure 3:
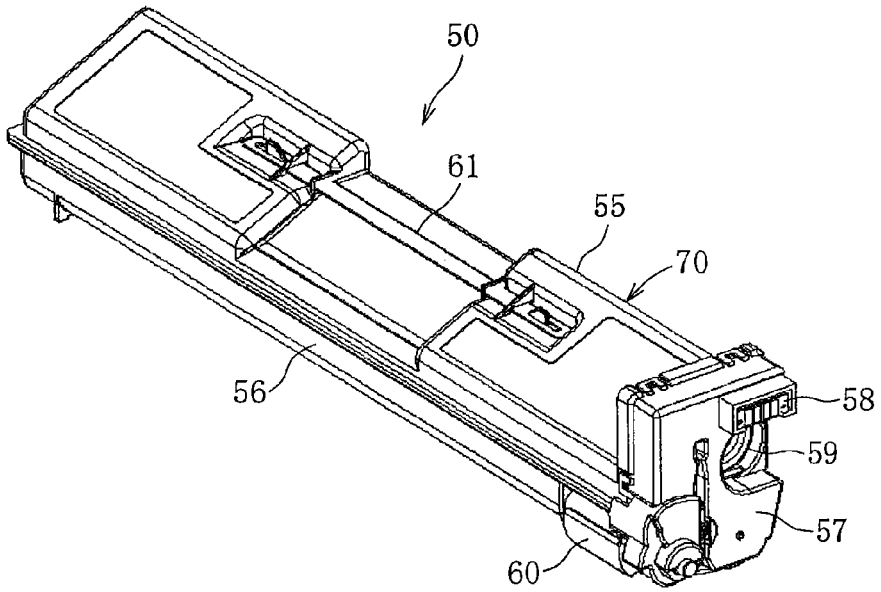
FIG. 3 is an external view of the toner cartridge.

FIG. 3 is a diagram showing an external appearance of the above-described toner cartridge. As shown in FIG. 3, the container body 70 of the toner cartridge 50 includes an upper case 55 and a lower case 56. The conveyance screw 53 and the agitator 54 are stored in an internal space formed by joining the upper case 55 and the lower case 56. As a method of joining the upper case 55 and the lower case 56, a welding method such as vibration welding or ultrasonic welding, or a bonding method utilizing a two-faced adhesive tape or an adhesion bond may be used.

A gear cover 57 is disposed at a side surface placed at an end in the longitudinal direction of the upper case 55 and the lower case 56. Plural gears are stored inside the gear cover 57 as a transmission unit for transmitting driving forces to the conveyance screw 53 and the agitator 54. The gears are covered by the gear cover 57 so as to prevent a user or the like from erroneously touching the gear during a replacement process for replacing the toner cartridge 50.

The gear cover 57 includes an information storing medium 58. The information storing medium 58 stores information regarding the toner cartridge 50 such as a color of the toner stored in the toner cartridge 50. The information storing medium 58 includes plural connecting terminals. When the plural connecting terminals are electrically connected to an information reading unit (not shown) disposed at the image forming apparatus main body 100, the information reading unit can read the information regarding the toner cartridge 50 and can update the information stored in the information storing medium 58.

A cap member 59 for sealing a supply opening of the toner cartridge 50 for supplying toner into the toner storing space 51 and an external shutter 60 for opening and closing the discharge opening 52 from outside are disposed at the end of the toner cartridge 50 where the gear cover 57 is provided. The shape of the external shutter 60 is a plate rounded along the surface where the discharge opening 52 is disposed. The cap member 59 is attached so as to prevent the toner from leaking through the supply opening of the toner cartridge 50, after the toner has been supplied inside the toner cartridge 50 through the supply opening. The external shutter 60 is rotatably attached to the container body 70. The discharge opening 52 is switched between an open state and a closed state by the rotation of the external shutter 60.

A grip 61 is arranged on an upper surface of a center in the longitudinal direction of the container body 70. The grip 61 is formed of, for example, a flexible member which is made of a material such as polypropylene or polyethylene. When the toner cartridge 50 is replaced, the user or the like can easily attach and detach the toner cartridge 50 by holding the grip 61.

Figure 4:
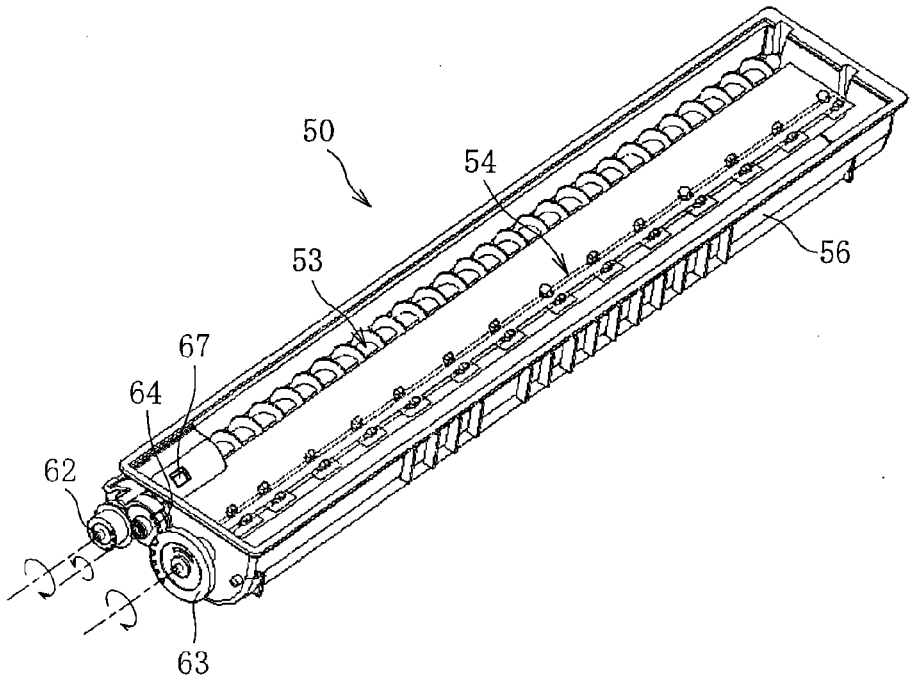
FIG. 4 is a perspective view showing a state where an upper case and a gear cover are removed from the toner cartridge.

FIG. 4 shows a state where the upper case 55 and the gear cover 57 are removed from the toner cartridge 50. In FIG. 4, the reference numerals 62, 63, and 64 are the plural gears stored inside the above-described gear cover 57. Among these gears, the gear indicated by the reference numeral 62 is a conveying drive gear attached to the rotational shaft 530 of the conveyance screw 53, which protrudes from the side surface at the end of the lower case 56. The gear indicated by the reference numeral 63 is an agitating drive gear attached to the rotational shaft 540 of the agitator 54, which protrudes from the side surface at the end of the lower case 56. The gear indicated by the reference numeral 64 is a torque transmission gear that transmits a rotational torque while engaging with the conveying drive gear 62 and the agitating drive gear 63. These gears 62, 63, and 64 are driving force transmitter to interlock the conveyance screw 53 with the agitator 54.

Bearings 80 and 81 (cf. FIG. 28) are disposed at portions where the rotational shaft 530 of the conveyance screw 53 and the rotational shaft 540 of the agitator 54 are passed through the lower case 56. The bearing members 80 and 81 support the corresponding rotational shafts 530 and 540. The bearings 80 and 81 have sealing functions for preventing the toner from leaking through the portions where the rotational shaft 530 and the conveyance screw 53 are passed through the lower case 56. For the sealing functions of the corresponding bearings 80 and 81, for example, G-seals may be utilized. The G-seal is sealing made of a rubber having a substantially G-shape. The G-seal secures a shaft in a radial direction by an elastic sealing lip that is integrally formed with a ring main body at an inner circumferential portion of the ring main body. Further, as a bearing that is less expensive than the bearing for which the G-seal is utilized, a bearing formed by combining a sponge having high hardness and a resin bearing such as POM may be utilized.

In the first embodiment, when the toner cartridge 50 is attached to the apparatus main body 100, the conveying drive gear 62 engages with a main body side drive gear 105 (cf. FIG. 15), which is included in the apparatus main body 100. When the main body side drive gear 105 is rotationally driven in this condition, the conveying drive gear 62, the torque transmission gear 64, and the agitating drive gear 63 rotate in the corresponding directions indicated by the arrows in FIG. 4, and thereby the conveyance screw 53 and the agitator 54 rotate.

Further, the conveying drive gear 62 in the first embodiment is formed as a two stage gear having a large diameter gear and a small diameter gear. The torque transmission gear 64 engages with the large diameter gear, and the main body side drive gear 105 engages with the small diameter gear.

Figure 5:
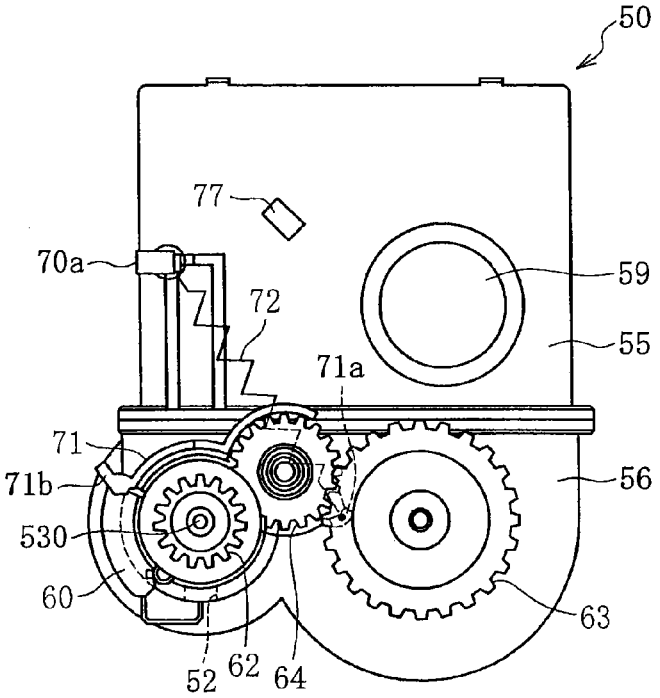
FIG. 5 is a side view showing a state where the gear cover of the toner cartridge is removed.
Figure 6:
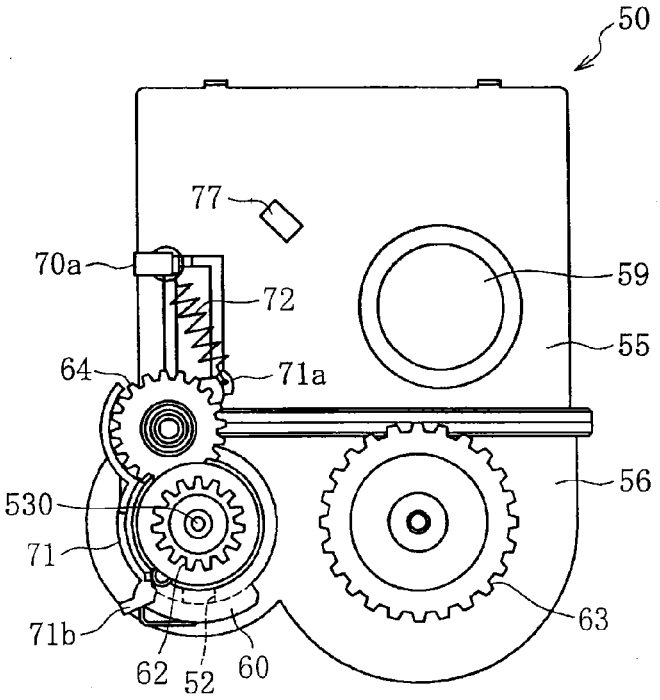
FIG. 6 is a side view showing a state where the gear cover of the toner cartridge is removed.

Hereinafter, the configuration of the above-described toner cartridge 50 is further explained in detail. FIGS. 5 and 6 are side views showing the toner cartridge 50 in a state where the gear cover 57 is removed. In the first embodiment, the torque transmission gear 64 is moveable between an operating position where the torque transmission gear 64 engages with other gears 62 and 63 to transmit a torque as shown in FIG. 5 and a retracted position where the torque transmission gear 64 is retracted from the operating position as shown in FIG. 6. Specifically, the torque transmission gear 64 is arranged in a gear holder 71. The gear holder 71 can pivot around the rotational shaft 530 of the conveyance screw 53 (or the conveying drive gear 62), while being centered on the rotational shaft 530. The position of the torque transmission gear 64 is switched between the operating position that is shown in FIG. 5 and the retracted position that is shown in FIG. 6 by the pivot of the gear holder 71.

In the first embodiment, a sequence of gears is formed by the three gears 62, 63, and 64. However, the sequence of gears may be formed by two gears or four or more gears. Further, plural gears included in the sequence of gears may be moved between the operating position and the retracted position.

Figure 7:
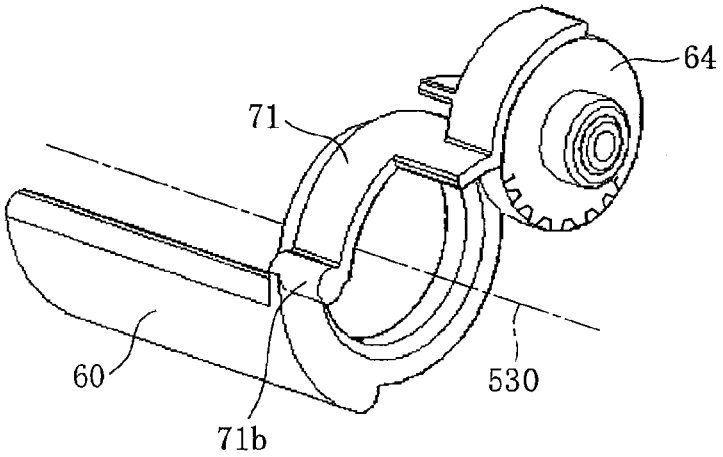
FIG. 7 is a perspective view of a gear holder.

As shown in FIG. 7, the external shutter 60 is integrally formed with the gear holder 71. Therefore, as shown in FIGS. 5 and 6, when the gear holder 71 pivots, the external shutter 60 also pivots around the rotational shaft 530 of the conveyance screw 53, while being centered on the rotational shaft 530. In this case, as shown in FIG. 5, the discharge opening 52 is opened by the external shutter 60 in a state where the torque transmission gear 64 is disposed at the operating position. On the other hand, as shown in FIG. 6, the discharge opening 52 is closed by the external shutter 60 in a state where the torque transmission gear 64 is disposed at the retracted position. In other words, the external shutter is formed to be linked to the movement of the torque transmission gear 64 between the operating position and the retracted position.

Further, as shown in FIGS. 5 and 6, one end of a tension spring 72 that functions as a biasing member is hooked on a first hook 71*a* disposed at the gear holder 71. The first hook 71*a* is adjacent to the torque transmission gear 64. The other end of the tension spring 72 is hooked to a second hook 70*a* disposed at a side surface of the upper case 55. The gear holder 71 is biased by a tension (a bias force) from the tension spring 72, so as to remove the torque transmission gear 64 from the agitating drive gear 63. Therefore, in a state where an external force does not act on the gear holder 71, as shown in FIG. 6, the gear holder 71 is pulled upward by the tension spring 72, and the torque transmission gear 64 is disposed at the retracted position.

Figure 15:
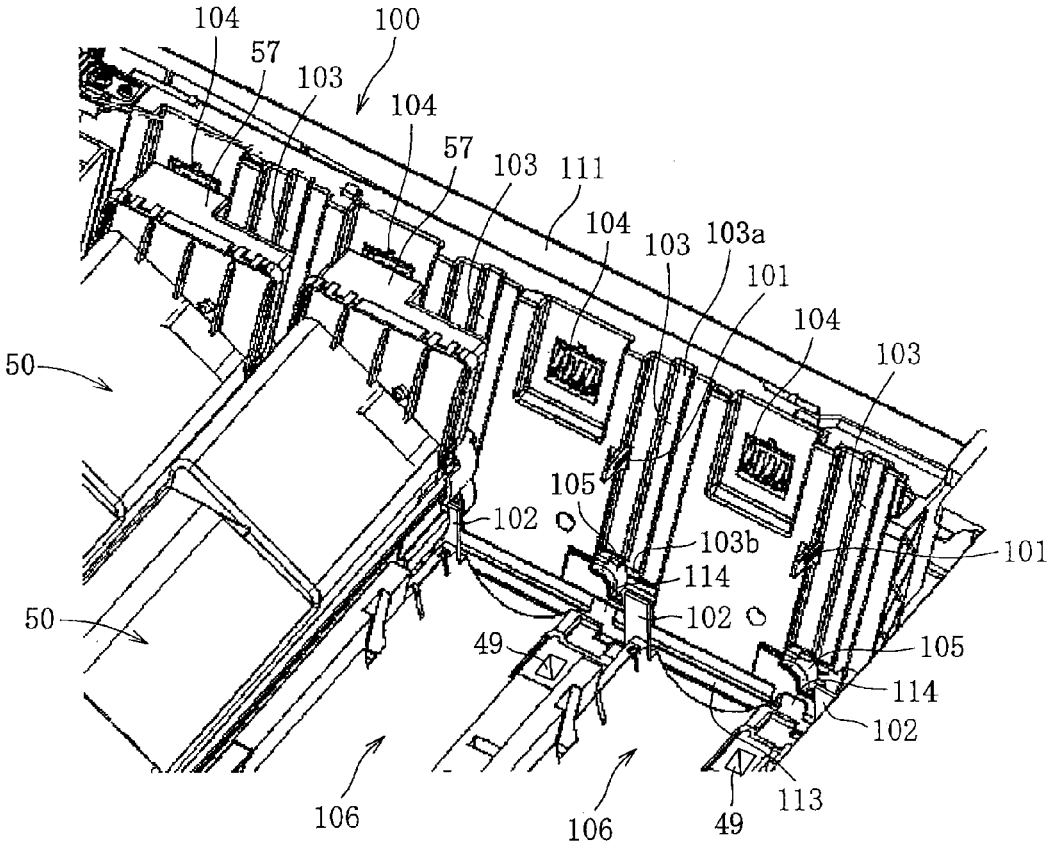
FIG. 15 is a perspective view showing an internal structure of one of side walls of a main body of the image forming apparatus.
Figure 16:
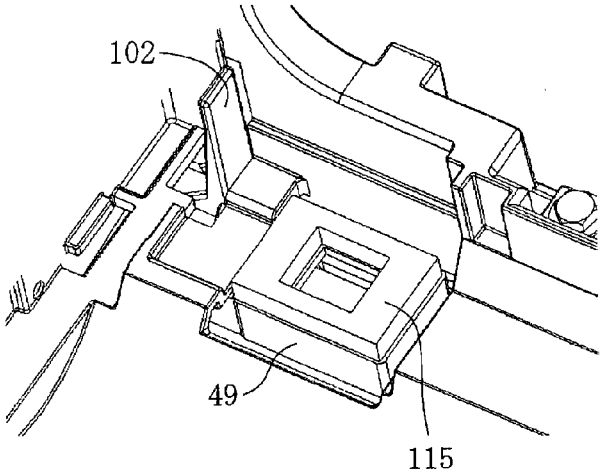
FIG. 16 is an enlarged view of a supply opening.

Further, the gear holder 71 includes a gear holder protrusion 71*b* as a pushed portion disposed at a position where an apparatus main body protrusion 102 as a main body side pushing portion included in the mounting portion 106 of the apparatus main body 100 contacts and pushes up the gear holder protrusion 71*b* (cf. FIG. 15), when the toner cartridge 50 is attached to the apparatus main body 100. The shape of the apparatus main body protrusion 102 is a plate extending vertically from the bottom of the mounting portion 106 near the supply opening 115 as shown in FIG. 16.

Figure 8:
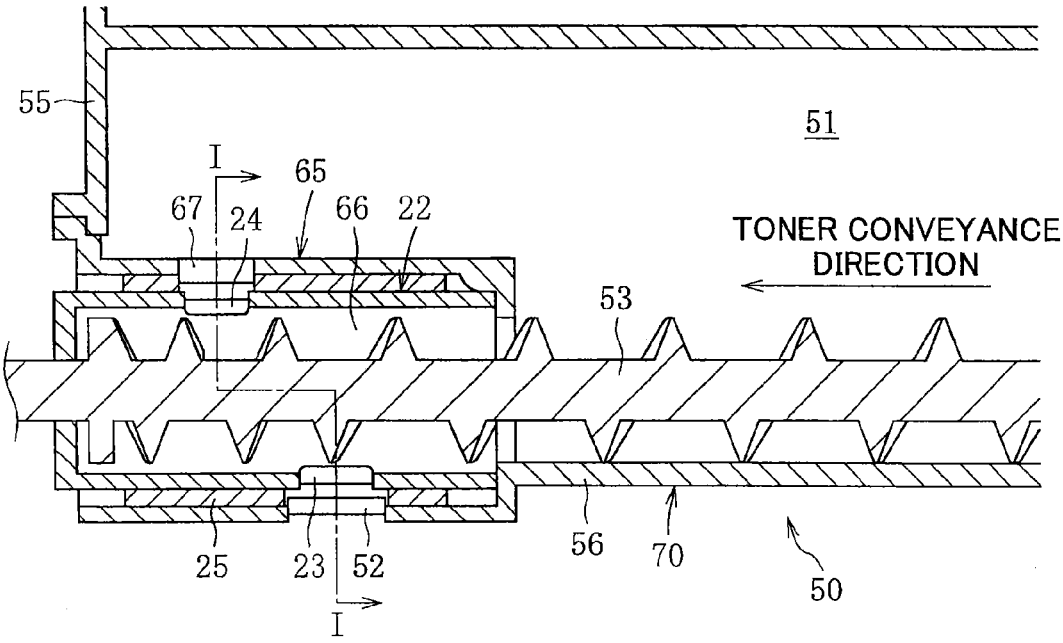
FIG. 8 is a cross-sectional view of the toner cartridge where the toner cartridge is cut at a position of a conveyance screw in a direction of an axis of the conveyance screw.

FIG. 8 is a cross-sectional view of the toner cartridge 50 in which the toner cartridge 50 is cut at the position of the conveyance screw 53 perpendicular to the direction of the rotational shaft 530. As shown in FIG. 8, an internal shutter 22 is disposed inside the container body 70. The internal shutter 22 is for opening and closing the discharge opening 52 from inside. As described, in the first embodiment, a double shutter configuration is adopted such that it includes the internal shutter 22 for opening and closing the discharge opening 52 from inside and the external shutter 60 for opening and closing the discharge opening 52 from outside.

The internal shutter 22 is formed to have a cylindrical shape. An inner opening 23 is formed on a peripheral wall of the internal shutter 22. The state of the discharge opening 52 can be switched between an open state where the inner opening 23 overlaps with the discharge opening 52 and a closed state where the peripheral wall of the internal shutter 22 overlaps with the discharge opening 52 (a state where the inner opening 23 does not overlap with the discharge opening 52).

A downstream portion in the toner conveyance direction of the conveyance screw 53 is placed inside the internal shutter 22. An internal space of the internal shutter 22 is a toner conveyance passage 66 as a developer conveyance passage where the toner is conveyed by the toner conveyance screw 53.

Further, the internal shutter 22 includes a return opening 24 for returning the toner that has not been discharged from the discharge opening 52 from the interior of the internal shutter 22 (toner conveyance passage 66) to the interior of the toner storing space 51. The return opening 24 is disposed at a downstream side of the inner opening 23 in the toner conveyance direction.

A roof portion 65 having a half-cylinder shape is disposed on an outer circumferential side of the internal shutter 22. The internal shutter 22 is supported so that it can be pivoted between the roof portion 65 and an internal surface of the container body 70. Here, the internal shutter 22 may be rotatably supported by cantilevering one end of the internal shutter 22, without providing the roof portion. However, by providing the roof portion 65, the interior surface of the cylinder functions as a bearing, and the rotating position of the internal shutter 22 can be stabilized. Further, the roof portion 65 includes a second return opening 67 that is arranged at a position corresponding to the return opening 24 of the internal shutter 22.

Further, cylindrical sealing members 25 are disposed at a space between the outer circumferential surface of the internal shutter 22 and the internal circumferential surface of the roof portion 65 and a space between the internal circumferential surface of the internal shutter 22 and the internal wall surface of the container body 70, so as to prevent the toner from leaking from these spaces.

Figure 9A:
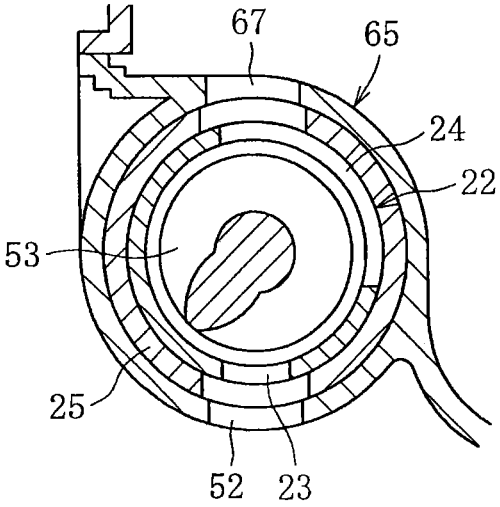
FIG. 9A is a cross-sectional view of the vicinity of a discharge opening in a state where the discharge opening is opened.
Figure 9B:
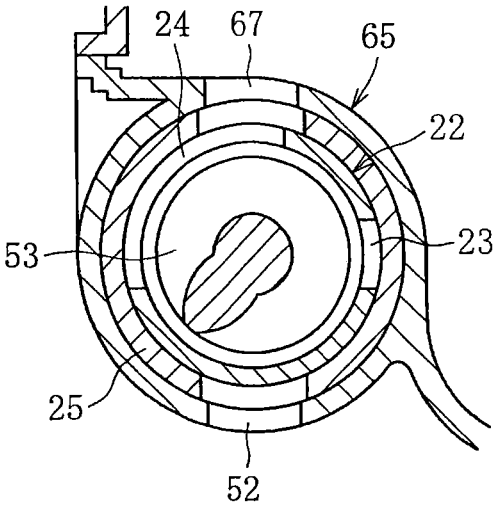
FIG. 9B is a cross-sectional view of the vicinity of the discharge opening in a state where the discharge opening is closed.

FIG. 9A is a diagram showing a cross-section I-I in FIG. 8. FIG. 9A shows an open state where the inner opening 23 overlaps with the discharge opening 52. On the other hand, FIG. 9B shows a closed state where the inner opening 23 does not overlap with the discharge opening 52. As shown in FIG. 9A, the return opening 24 formed in the internal shutter 22 is extending in the circumferential direction of the internal shutter 22. The return opening 24 has an opening that is larger than an opening of the inner opening 23 in the circumferential direction. By forming the return opening 24 of the internal shutter 22 in this way, a part of the return portion 24 of the internal shutter 22 can be overlapped with the second return opening 67 of the roof portion 65, regardless of the return opening 24 being in the open state shown in FIG. 9A or in the closed state shown in FIG. 9B.

Figure 10A:
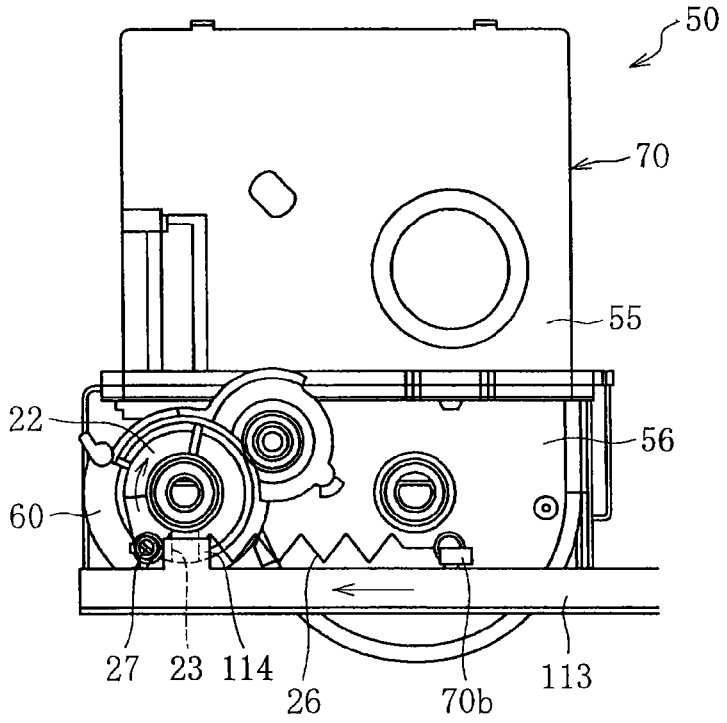
FIG. 10A is a diagram showing a state where an inside shutter is opened by a driving unit.
Figure 10B:
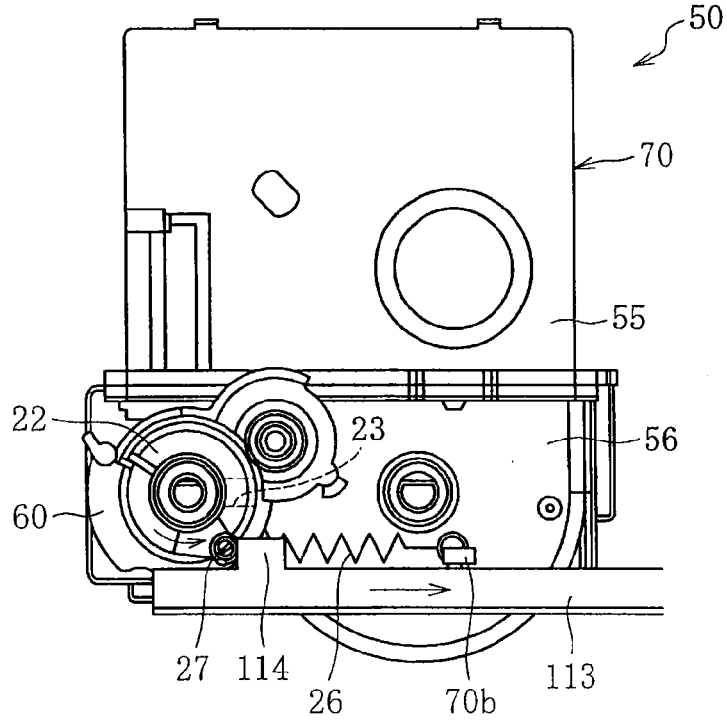
FIG. 10B is a diagram showing a state where the inside shutter is closed by the driving unit.
Figure 11:
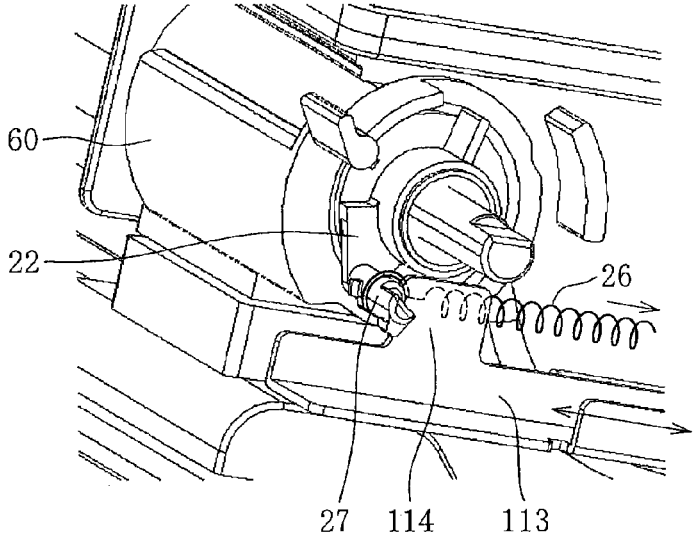
FIG. 11 is a perspective view of the inside shutter and the driving unit, viewed from outside.

FIG. 10A is a diagram showing a state where the internal shutter 22 is opened by a driving unit. FIG. 10B is a diagram showing a state where the internal shutter 22 is closed. Further, FIG. 11 is a perspective view of the internal shutter and the driving unit, which are viewed from outside. In FIGS. 10 and 11, the gear cover 57 and the gears such as the conveying driving gear 62 are removed from the toner cartridge 50. Herein after, the driving unit of the internal shutter 22 is explained, based on FIGS. 10 and 11.

As shown in FIGS. 10 and 11, the internal shutter 22 is driven, for example, by a tension spring 26 that functions as a biasing member that applies a bias to the internal shutter 22 attached to the toner cartridge 50, an internal shutter protrusion 27 formed on the internal shutter 22, and a moving member 113 that is disposed in the mounting portion 106 of the apparatus main body 100 and that can be moved in the horizontal direction.

The internal shutter protrusion 27 is formed at an end of the internal shutter 22 that is exposed from the lower case 56. The internal shutter protrusion 27 protrudes in the axis direction of the internal shutter 22. The tension spring 26 is hooked to the internal shutter protrusion 27 and a hook 70*b*. In other words, the tension spring 26 is disposed between the toner container 50 and the internal shutter 22.

The moving member 113 is a longitudinally shaped member extending in the horizontal direction. The moving member 113 is movably attached to the apparatus main body 100. The moving member 113 is formed to be reciprocated in the horizontal direction by a driving unit arranged in the apparatus main body 100. As a driving unit of the moving member 113, it is preferable to use a device having a small fluctuation in the moving amount, such as a solenoid or a cam mechanism. Further, the moving member 113 has a convex shape 114 that can abut to the internal shutter protrusion 27.

Subsequently, the opening and closing operations of the internal shutter 22 are explained while referring to FIGS. 10A and 10B. As shown in FIG. 10A, when the moving member 113 is moved in the left direction in the figure, the convex shape 114 of the moving member 113 presses the internal shutter protrusion 27 against the bias force from the tension spring 26, and thereby pivoting the internal shutter 22 in the clockwise direction in the figure. As a consequence, the inner opening 23 is arranged to face downwardly in the figure, and the inner opening 23 is opened as shown in FIG. 9A.

Contrary to this, when the moving member 113 is moved in the right direction as shown in FIG. 10B, there is no force to press the internal shutter protrusion 27. Thus, the internal shutter 22 pivots in the counterclockwise direction in the figure by the bias force of the tension spring 26. Consequently, the inner opening 23 is directed in the right direction in the figure, and the inner opening 23 is closed as shown in FIG. 9B.

Figure 12:
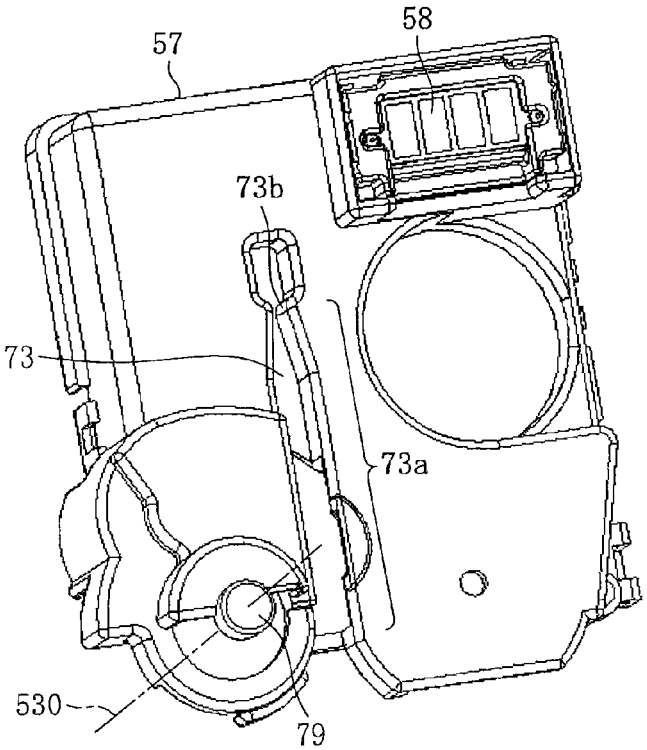
FIG. 12 is a perspective view of a gear cover, viewed from a front side of the gear cover.

FIG. 12 is a perspective view of the gear cover 57, which is viewed from the front side. As shown in FIG. 12, a groove 73 is disposed in the vertical direction on the outer surface of the gear cover 57 (front surface). When the toner cartridge 50 is attached to the apparatus main body 100, the groove 73 cooperates with a protrusion 101 (cf. FIG. 15) as a main body side portion protruded horizontally from the inner side surface of the mounting portion 106 of the apparatus main body 100, and thereby the groove 73 functions to guide the toner cartridge 50 in the direction in which the toner cartridge 50 is attached to the apparatus main body 100 and functions to position the toner cartridge 50 with respect to the position of the apparatus main body 100. Hereinafter the protrusion 101 is named a horizontal protrusion 101 for the convenience. Specifically, in the groove 73, a range from the lower end to a part next to the upper narrowing width is a container guiding portion 73*a* having the function for guiding, and the upper narrowing width is a container positioning portion 73*b* having the function for positioning. The lower end f the container guiding portion 73*a* opens downward. The open width of the container guiding portion 73*a* at the lower end is set to be large, and the upper part of the container guiding portion 73*a* is formed such that its width gradually narrows toward the container positioning portion 73*b*.

Further, a positioning convex 79 is formed at the front side of the gear cover 57. The positioning convex 79 functions as another container guiding portion and another container positioning portion of the toner cartridge 50 with respect to the mounting portion 106 of the apparatus main body 100. The positioning convex 79 cooperates with a main body groove 103 (cf. FIG. 15) disposed in the apparatus main body 100, and thereby the positioning convex 79 functions to guide the toner cartridge 50 in the direction in which the toner cartridge 50 is attached to the apparatus main body 100 and functions to position the toner cartridge 50 with respect to the position of the apparatus main body 100. In this manner, in the first embodiment, the position of the toner cartridge 50 is positioned with the apparatus main body 100 by using the two positions, namely, the container positioning portion 73*b* and the positioning convex 79 shown in FIG. 12.

Figure 13:
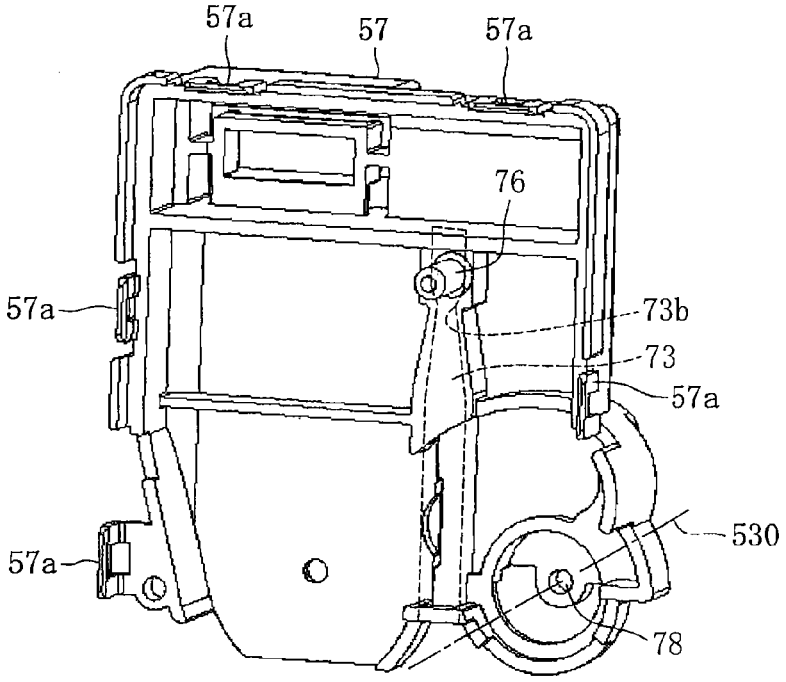
FIG. 13 is a perspective view of the gear cover, viewed from a rear side of the gear cover.

FIG. 13 is a perspective view of the gear cover 57, which is viewed from the rear side. As shown in FIG. 13, a boss 76 for positioning is protruding in the rear side of the gear cover 57. When the gear cover 57 is attached to the case 55 and 56, the boss 76 is inserted into an elongate hole 77 (cf. FIG. 5, a rectangular hole) disposed at a side surface of the upper case 55. In this manner, the gear cover 57 is positioned with the upper case 55. The gear cover 57 is attached to the case 55 and 56 by engaging elastically deformable engagement pieces arranged on a surrounding edge of the gear cover 57 with pawls arranged in the corresponding counter parts of the end of the cases 55 and 56.

Further, a hole 78 is formed in the rear side of the gear cover 57. The end of the rotational shaft 530 that is a part of the conveyance screw 53 and protrudes from the lower case 56 is inserted into the hole 78. Namely, the gear cover 57 is positioned with the lower case 56 by supporting the rotational shaft 530 with the hole 78. In this manner, in the first embodiment, the cases 55 and 56 are positioned with the gear cover 57 by the two positioning, namely, by the boss 76 and the hole 78 shown in FIG. 13. Specifically, the upper case 55 is positioned with the gear cover 57 by the boss 76 shown in FIG. 13. Similarly, the lower case 56 is positioned with the gear cover 57 by the hole 78 shown in FIG. 13.

As described above, in the first embodiment, the two positioning portions for positioning the gear cover 57 in the apparatus main body 100 are arranged in the front side of the gear cover 57, and the two positioning portions for positioning the gear cover 57 on the cases 55 and 56 are arranged in the rear side of the gear cover 57. The two positioning portions in the front side of the gear cover 57 are disposed at the same or almost the same locations at which the corresponding two positioning portions in the rear side of the gear cover 57 are disposed. Specifically, the boss 76 shown in FIG. 13 is disposed in the vicinity of the rear side of the container positioning portion 73*b* of the groove 73 shown in FIG. 12, and the hole 78 shown in FIG. 13 is disposed at the rear side of the positioning convex 79 shown in FIG. 12.

Figure 14:
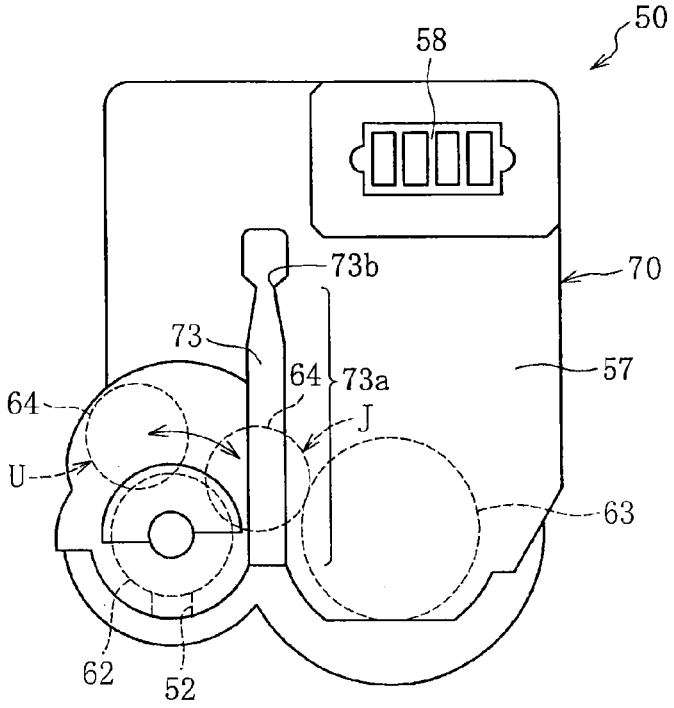
FIG. 14 is a diagram showing the toner cartridge, viewed from a side of the gear cover.

FIG. 14 is a diagram showing the toner cartridge 50, which is viewed from the side of the gear cover 57. In FIG. 14, projected areas of the corresponding gears 62, 63, and 64 on the outer surface of the gear cover 57 are shown by the dashed lines. Here, the groove 73 is disposed on the outer surface of the gear cover 57. The area shown by the reference symbol J is the projected area of the torque transmission gear 64 disposed at the operating position, and the area shown by the reference symbol U is the projected area of the torque transmission gear 64 disposed at the retracted position. In this manner, in the first embodiment, a part of the container guiding portion 73*a* of the groove 73 is positioned within the projected area J of the torque transmission gear 64 disposed at the operating position. Here, the whole of the container guiding portion 73*a* may be positioned within the projected area J of the torque transmission gear 64 disposed at the operating position. On the other hand, the container positioning portion 73*b* having a smaller width is required to be positioned outside the projected area J of the torque transmission gear 64 disposed at the operating position.

Hereinafter, the configuration of the apparatus main body 100 is explained. As shown in FIG. 15, the plural mounting portions 106 for mounting the toner cartridges 50 for the corresponding colors are arranged in the apparatus main body 100. For each of the toner cartridges 50, the corresponding mounting portion 106 is provided. Namely, there are four mounting portions 106. In FIG. 15, the two toner cartridges 50 are mounted on the corresponding two mounting portions 106 among the four mounting portions 106. The correspondence between the toner cartridges 50 and the mounting portions 106 is determined by colors of the toner inside the corresponding toner cartridges 50.

Each of the mounting portions 106 includes the apparatus main body protrusion 102 that protrudes upwardly.

When the toner cartridge 50 is attached to the apparatus main body 100, the apparatus main body protrusion 102 pushes up the gear holder protrusion 71*b* (cf. FIG. 7) of the gear holder 71.

Four connecting terminals 104 of the information reading unit are disposed on an interior surface of one of side walls 111 shown in FIG. 15. When the toner cartridge 50 is attached to the apparatus main body 100, these connecting terminals 104 are connected to the corresponding connecting terminals of the information storing medium 58 disposed in the gear cover 57 of the toner cartridge 50.

Further, the horizontal protrusions 101 that protrude in the horizontal direction are disposed on the interior surface of the side wall 111 of the mounting portion 106 of the apparatus main body 100. Each of the horizontal protrusions 101 cooperates with the groove 73 disposed on the gear cover 57 (cf. FIG. 12), and thereby functions as a main body side guiding portion that guides the toner cartridge 50 in the direction in which the toner cartridge 50 is attached to the apparatus main body 100 and functions as a main body side positioning portion for positioning the toner cartridge 50 in the apparatus main body 100.

Further, for each of the mounting portions 106, a main body groove 103 is vertically disposed on the interior surface of the side wall 111 of the apparatus main body 100 as a main body side guiding portion and a main body side positioning portion, other than the above-described horizontal protrusion 101. An upper end 103*a* of each of the apparatus main body grooves 103 opens upward. The positioning convex 79 (cf. FIG. 12) formed on the toner cartridge 50 can be inserted into the upper end portion 103*a*, which is opened. On the other hand, a receiving portion for receiving the positioning convex 79 is formed at a lower end 103*b* of the main body groove 103. Namely, the lower end 103*b* of the main body groove 103 functions as the main body side positioning portion for positioning the positioning convex 79, and the range from the top end 103*a* to the lower end 103*b* of the main body groove 103 excluding the lower end 103*b* functions as the main body side guiding portion for guiding the positioning convex 79.

Further, the main body side drive gear 105 is disposed in the vicinity of the lower end 103*b* of each of the main body grooves 103. The main body side drive gear 105 is rotationally driven by a driving source disposed in the apparatus main body 100. Further, when the toner cartridge 50 is attached to the apparatus main body 100, the main body side drive gear 105 engages with the conveying drive gear 62 (cf. FIG. 5).

The moving member 113 for rotationally driving the internal shutter 22 is disposed in the apparatus main body 100. As shown in FIG. 15, the moving member 113 has plural convex shapes 114 that abut the protrusions 27 of the corresponding toner cartridges 50.

Figure 17:
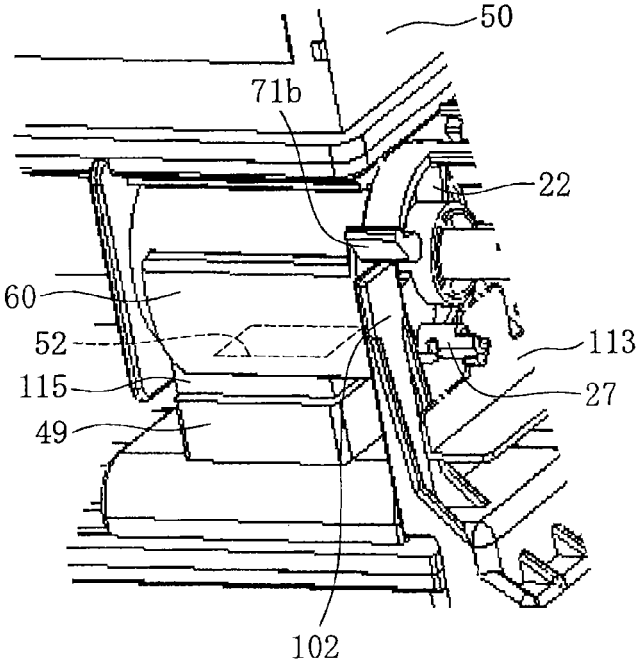
FIG. 17 is a diagram showing a state where the discharge opening and the supply opening are connected.

As shown in FIG. 16, a sealing member 115 is disposed at a flange of the supply opening 49 arranged in the apparatus main body 100. Therefore, as shown in FIG. 17, in a state where the discharge opening 52 and the supply opening 49 are connected, the sealing member 115 is disposed between the two openings 49 and 52. In this manner, the space between the two openings 49 and 52 is sealed, and thereby preventing the toner from scattering within the apparatus.

Figure 18:
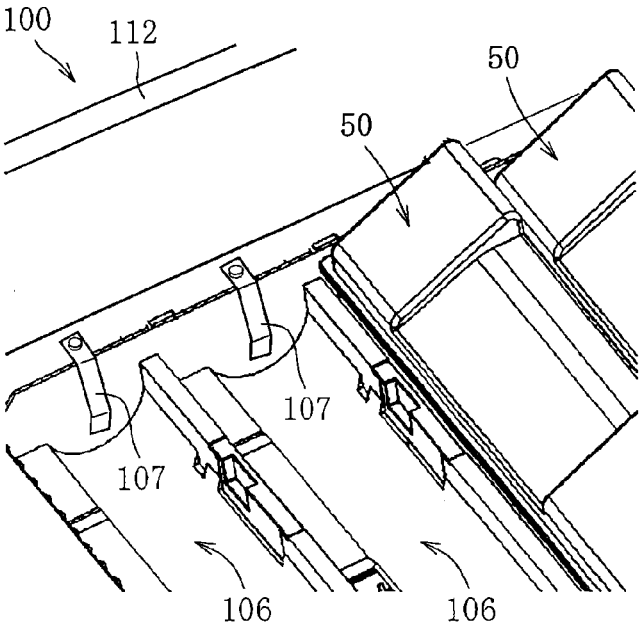
FIG. 18 is a perspective view showing an internal structure of the other side wall of the main body of the image forming apparatus.

FIG. 18 is a diagram showing an internal structure of the apparatus main body 100 at a side that is opposite to the side shown in FIG. 15. As shown in FIG. 18, for each of the mounting portions 106, a biasing member 107 is disposed at a side wall 112. The biasing member 107 biases the toner cartridge 50 toward the side wall 111 (opposite side of the side wall 112). In the first embodiment, the biasing member 107 is formed of a flat spring.

Hereinafter, operations for attaching and detaching the toner cartridge 50 are explained, while referring to FIGS. 19A, 19B, and 19C. When the toner cartridge 50 is to be attached to the apparatus main body 100, the upper cover 109 (cf. FIG. 1) of the apparatus main body 100 is opened so that the toner cartridge 50 can be mounted on the mounting portion 106. Then, the toner cartridge 50 is held, and as shown in FIG. 19A, the toner cartridge 50 is inserted into the upper opening portion of the apparatus main body 100 toward the mounting portion 106, which is disposed at a lower side.

Figures 19A, 19B, 19C:
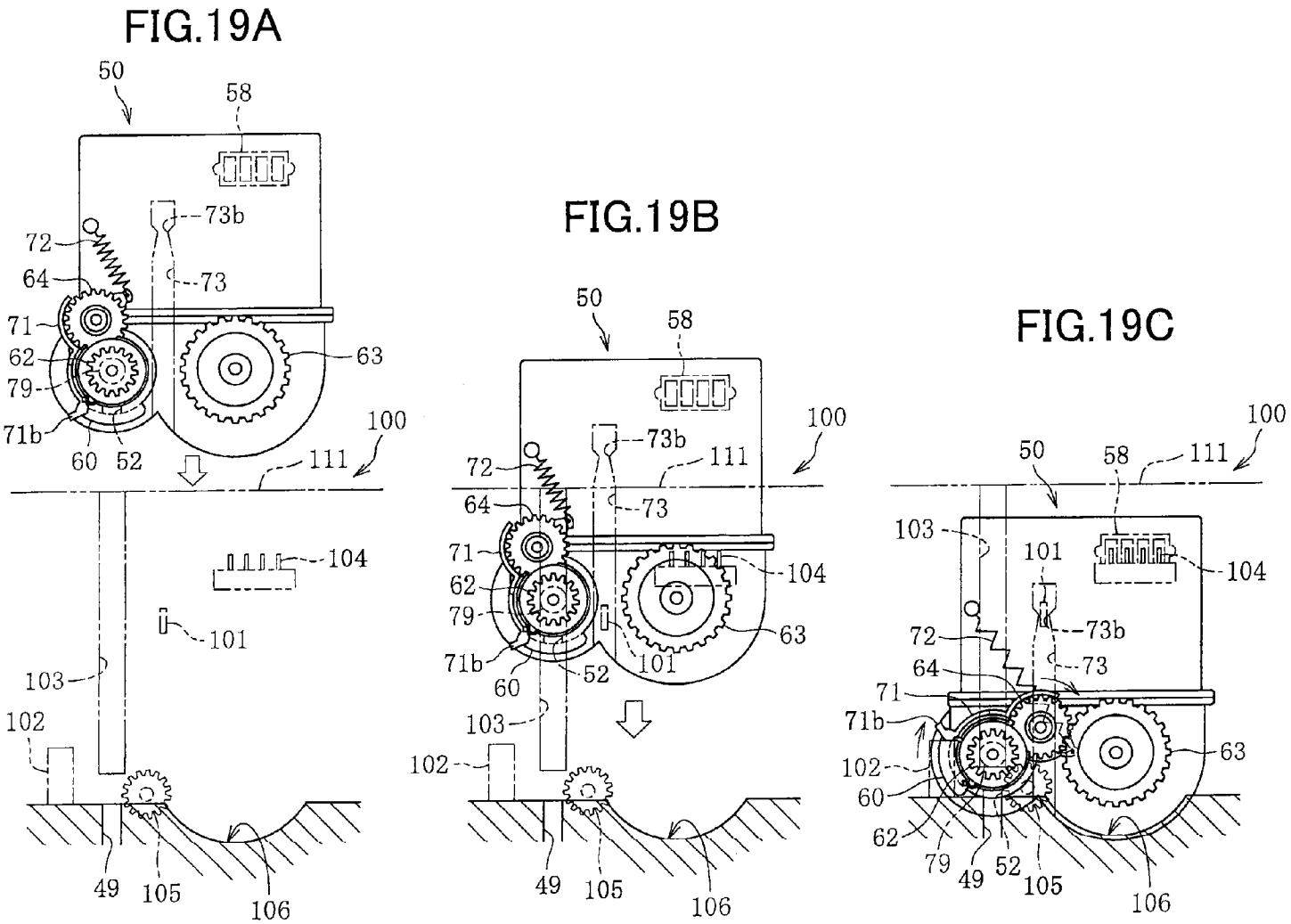
FIGS. 19A, 19B, and 19C are diagrams illustrating an operation of attaching the toner cartridge to the image forming apparatus main body and an operation of detaching the toner cartridge from the main body.

When the toner cartridge 50 is inserted inside the apparatus main body 100, the positioning convex 79 formed on the cartridge 50 is fitted on the main body groove 103, as shown in FIG. 19B. In this manner, by fitting the positioning convex 79 on the main body groove 103, the positioning convex 79 cooperates with the main body groove 103, and thereby the toner cartridge 50 is inserted into the apparatus main body 100 while being guided by the main body groove 103. When the toner cartridge 50 is further inserted downward, the horizontal protrusion 101 disposed in the apparatus main body 100 is fitted on the groove 73 disposed on the toner cartridge 50. Thus, the toner cartridge 50 is also guided by the fitting between the horizontal protrusion 101 and the groove 73.

Further, when the toner cartridge 50 is mounted on the mounting portion 106, as shown in FIG. 19C, the positioning convex 79 on the toner cartridge 50 abuts the lower end (the receiving portion) of the main body groove 103. The position of the toner cartridge 50 is aligned by the abutment. Specifically, the fitting between the positioning convex 79 and the lower end of the main body groove 103 regulates the downward movement of the toner cartridge 50 and the movement of the toner cartridge 50 in the horizontal direction along the side wall 111 (the horizontal direction in FIG. 19C).

Further, when the toner cartridge 50 is mounted on the mounting portion 106, the horizontal protrusion 101 in the apparatus main body 100 is fitted on the container positioning portion 73*b* where the width of the groove 73 is small. The toner cartridge 50 is also positioned by the fitting between the horizontal protrusion 101 and the container positioning portion 73*b*. Specifically, the fitting between the horizontal protrusion 101 and the container positioning portion 73*b* regulates the movement of the toner cartridge 50 in the rotational direction centered on the positioning convex 79.

Further, at the end of the toner cartridge 50 that is opposite to the side of the toner cartridge 50 where the toner cartridge 50 is positioned by the horizontal protrusion 101 and the groove 73, the biasing member 107 (cf. FIG. 18) disposed in the apparatus main body 100 biases the toner cartridge toward the side wall 111 on which the horizontal protrusion 101 of the apparatus main body 100 and the like are disposed. The bias force regulates the movement of the toner cartridge 50 in the direction perpendicular to the side wall 111 of the apparatus main body 100 (the direction perpendicular to the paper surface of FIG. 19C), and thereby preventing the positioning convex 79 from being come out of the main body groove 103 and preventing the horizontal protrusion 101 from being come out of the container positioning portion 73*b*. Especially, in the first embodiment, the biasing member 107 ensures that the plural connecting terminals of the information storing medium 58 are pressed to the corresponding connecting terminals on the main body. Namely, the biasing member 107 is also responsible for ensuring the electrical connections between the connecting terminals.

As shown in FIG. 19C, when the toner cartridge 50 is mounted on the mounting portion 106, the apparatus main body protrusion 102 pushes up the gear holder protrusion 71*b*. By this, the gear holder 71 pivots in the direction indicated by the arrow in FIG. 19C against the tension (the bias force) of the tension spring 72, and the torque transmission gear 64 is disposed at the position where the torque transmission gear 64 engages with the agitating drive gear 63. Further, when the gear holder 71 pivots, the external shutter 60 which is integrally formed with the gear holder 71 pivots, and the outer circumferential of the discharge opening 52 is opened. However, in this case (in the case where the toner cartridge 50 is mounted on the main body), the internal shutter 22 is kept closed. The effect of maintaining this closed state is explained. In the sequence of the processes, the external shutter 60 is opened. However, there is a moment at which the discharge opening 52 of the toner cartridge 50 is not connected to the supply opening 49 of the main body. In such a case, the toner may leak downward without the double shutter structure. However, since the internal shutter 22 is kept closed, the toner does not leak. Incidentally, when the torque transmission gear 64 moves to the operating position, since the horizontal protrusion 101 has already passed through the area that overlaps with the operating position on the groove 73 at a time in which the torque transmission gear 64 approaches to the groove 73, the torque transmission gear 64 does not interfere with the horizontal protrusion 101.

As described above, when the torque transmission gear 64 moves to the operating position and engages with the agitating drive gear 63, the conveyance screw 53 and the agitator 54 are coupled and in a state in which the drive can be transmitted. At the same time, the external shutter 60 which is integrally formed with the gear holder 71 pivots from the position shown in FIG. 19B to the position shown in FIG. 19C, and the discharge opening 52 is opened. The opened exhaust opening 52 is connected with the supply opening 49 at the side of the apparatus main body 100.

Subsequently, the internal shutter 22 is opened. Specifically, the moving member driving unit, such as the solenoid or the cam mechanism, moves the moving member 113, while triggered by the closing of the upper cover 109. For example, when the printer is turned on, the moving member 113 moves toward the left direction in the figure and opens the internal shutter 22, as shown in FIG. 10A. With this, both the internal shutter 22 and the external shutter 60 are opened, and the toner can be discharged from the discharge opening 52.

Figure 20:
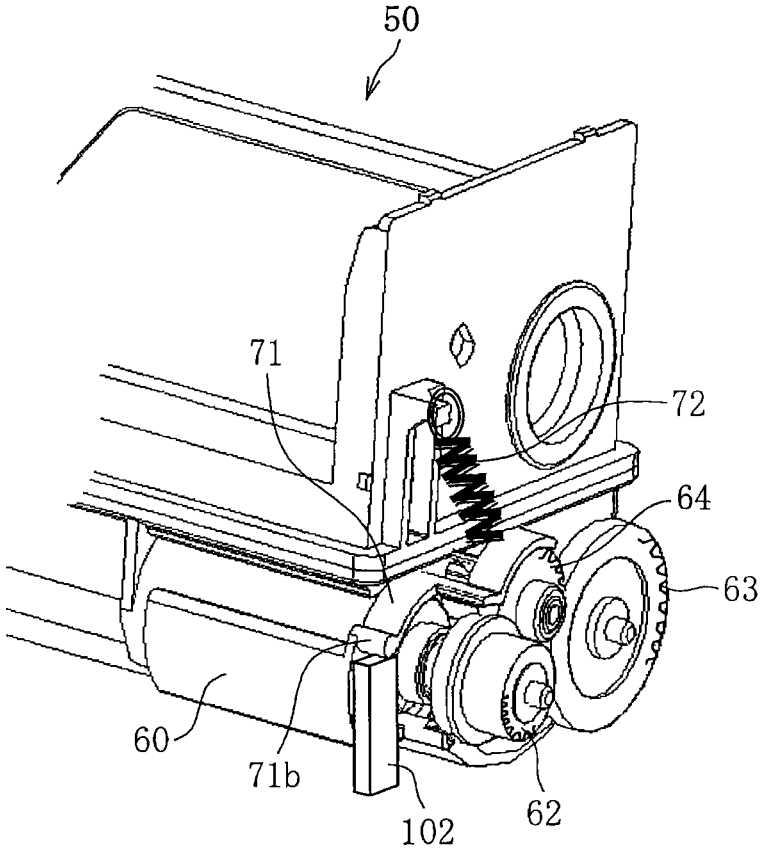
FIG. 20 is a perspective view showing a state where a torque transmission gear is disposed at an operating position.
Figure 21:
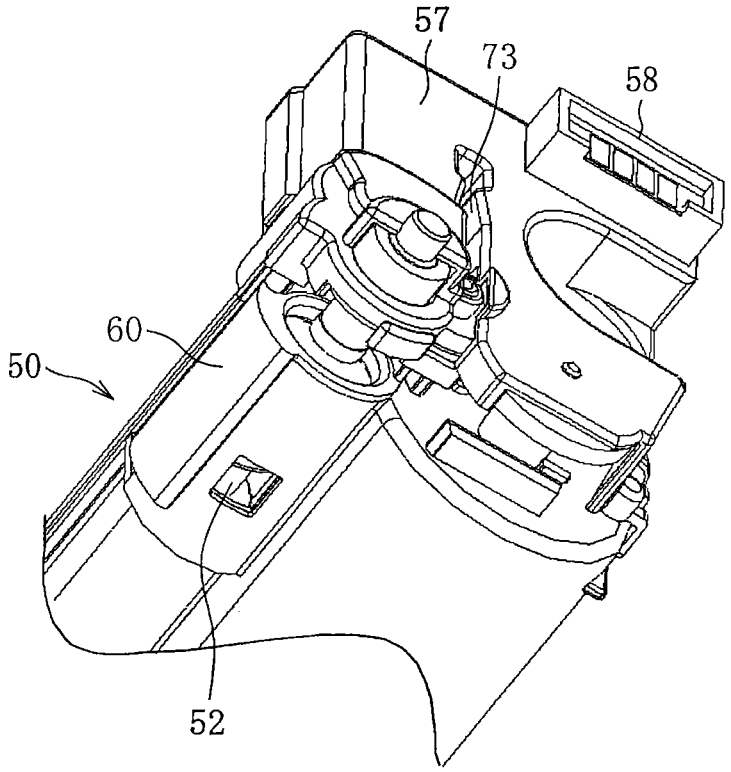
FIG. 21 is a perspective view showing a state where the discharge opening is opened.

FIG. 20 shows a state where the torque transmission gear 64 is disposed at the operating position. FIG. 21 shows a state where the discharge opening 52 is opened. In FIG. 20, the gear cover 57 is not shown.

Further, as shown in FIG. 19C, when the toner cartridge 50 is mounted on the mounting unit 106, the conveying drive gear 62 engages with the main body side drive gear 105. When the main body side drive gear 105 is rotationally driven by a driving source (not shown) in this state, the driving force is transmitted to the conveyance screw 53 and the agitator 54 through the conveying drive gear 62, the torque transmission gear 64, and the agitating drive gear 63, and the conveyance screw 53 and the agitator 54 are rotationally driven. With this, the toner is supplied from the opened exhaust opening 52 to the developing device through the supply opening 49.

Further, when the toner cartridge 50 is mounted on the mounting unit 106, the connecting terminals of the information storing medium 58 at the side of the toner cartridge 50 are connected to the corresponding connecting terminals 104 of the information reading device at the side of the apparatus main body 100. With this, the information regarding the toner cartridge 50 can be read, or the information stored in the information storing medium 58 can be updated.

When the toner cartridge 50 is removed from the apparatus main body 100, first, the internal shutter 22 is closed. Specifically, when the upper cover 109 is opened (cf. FIG. 1), the moving member driving unit cooperatively moves, and as shown in FIG. 10B, the moving member 113 is moved to the right direction in the figure, and thereby the internal shutter 22 is closed.

Subsequently, when the toner cartridge 50 is lifted up, as shown in FIG. 19B, the pushing up of the gear holder protrusion 71*b* by the apparatus main body protrusion 102 is released, and the gear holder 71 is pivoted by the tension (bias force) from the tension spring 72 and is returned to its original position. The torque transmission gear 64 is disposed at the retracted position where the torque transmission gear 64 is separated from the agitating drive gear 63, in accordance with the pivot of the gear holder 71. Incidentally, at this time, the horizontal protrusion 101 passes through the area which overlaps with the operating position on the groove 73. However, since the torque transmission gear 64 has already been retracted from the operating position on the groove 73 at the time at which the horizontal protrusion 101 reaches the area, the horizontal protrusion 101 does not interfere with the torque transmission gear 64.

Further, as shown in FIG. 19B, when the gear holder 71 is pivoted to its original position, the external shutter 60 is pivoted accordingly, and the discharge opening 52 is closed. With this, the internal shutter 22, which tends to become unclean due to the connection with the supply opening 49, is covered with the external shutter 60. Consequently, the likelihood that the hand of the user becomes unclean by contacting the shutter portion is lowered. Since the internal shutter 22 and the external shutter 60 are closed, the resistance against the scattering of the toner from the discharge opening 52 is significantly improved.

Figure 22:
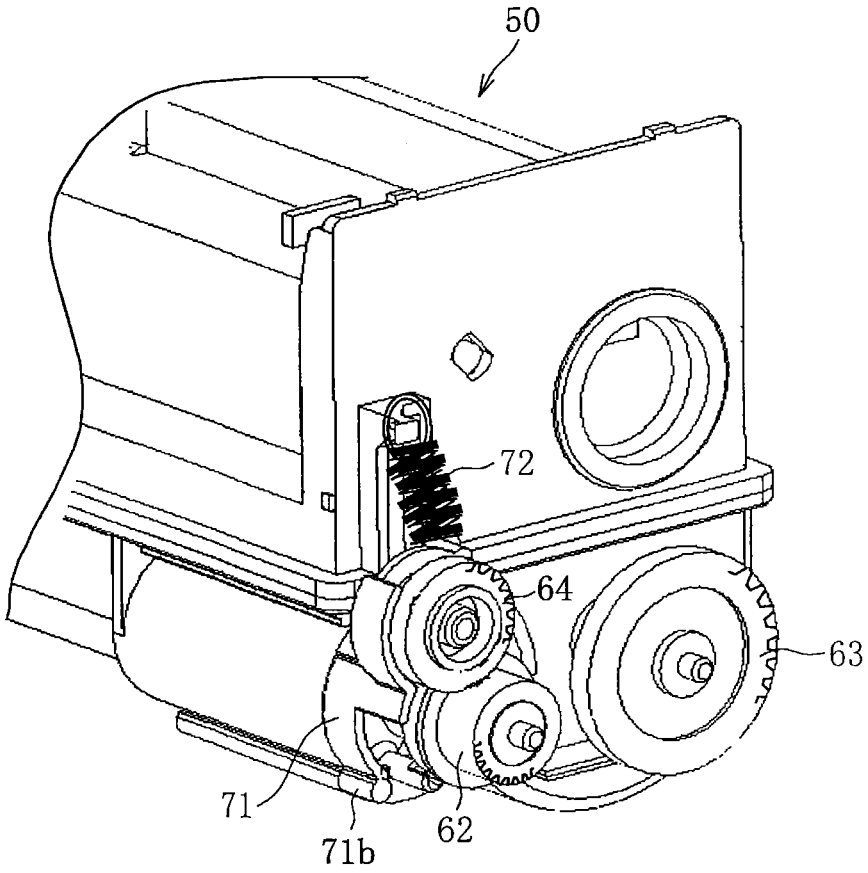
FIG. 22 is a perspective view showing a state where the torque transmission gear is disposed at a retracted position.
Figure 23:
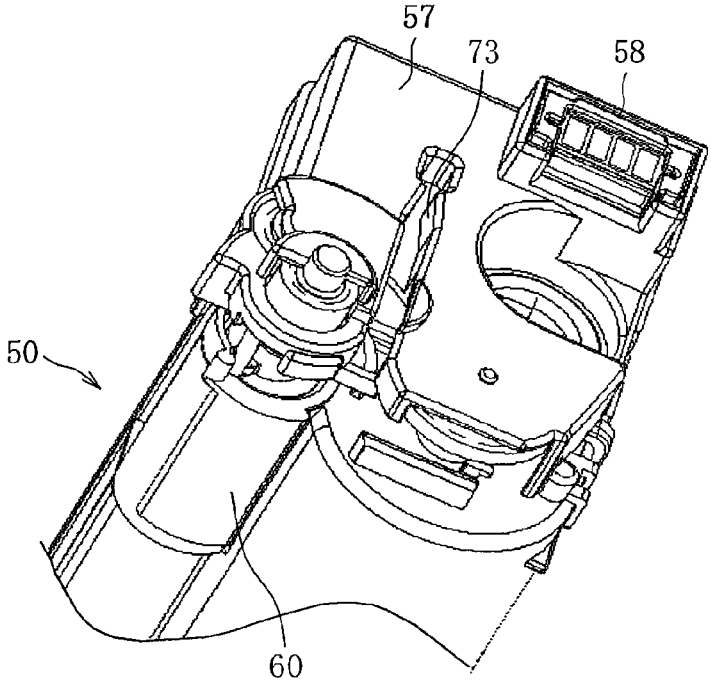
FIG. 23 is a perspective view showing a state where the discharge opening is closed.

FIG. 22 shows a state where the torque transmission gear 64 is disposed at the retracted position. FIG. 23 shows a state where the discharge opening 52 is closed. In FIG. 22, the gear cover 57 is not shown.

As described above, in the first embodiment, the user or the like is prevented from contacting the gears by covering the gears with the gear cover 57. However, since a part of the conveying drive gear 62 is exposed from the lower portion of the gear cover 57 so that the conveying drive gear 62 can be engaged with the main body side drive gear 105, it is possible that the user or the like contacts the conveying drive gear 62 during a replacement process of the toner cartridge 50. For example, if the user or the like rotates the conveying drive gear 62 when the toner cartridge 50 has been detached from the apparatus main body 100, the conveyance screw 53 rotates and the toner is conveyed. In this manner, if the toner clogs in the internal shutter 22 and a load is generated, it is possible that the toner is deteriorated and the conveyance screw 53 and the container body 70 are broken.

However, in the first embodiment, the return opening 24 is disposed in the internal shutter 22, and the second return opening 67 is disposed in the roof portion 65. Thus, even if the toner is conveyed by the conveyance screw 53, the toner can be returned to the toner storing space 51 through the return openings 24 and 67. Namely, as shown in FIG. 9B, when the toner cartridge 50 is detached, the discharge opening 52 is closed. However, since a portion of the return opening 24 of the internal shutter is overlapped with the second return opening 67 of the roof portion 65, the toner inside the internal shutter 22 can be returned through the return openings 24 and 67. The width of the second return opening 67 is wider than the width of the return opening 24 so that the second return opening 67 can overlap the both positions of the return opening 24, the side position and the lower position as shown in FIGS. 9*a* and 9*b*. In this manner, the load applied to the toner inside the internal shutter 22 can be decreased. Thus, the toner can be prevented from being deteriorated, and the conveyance screw 53 and the container body 70 are prevented from being broken.

Further, in the first embodiment, when the toner cartridge 50 is detached from the apparatus main body 100, the torque transmission gear 64 is moved to the retracted position, as shown in FIG. 19A. Thus, the conveyance drive gear 62 is disengaged from the agitating drive gear 63. Therefore, if the user or the like rotates the conveying drive gear 62 in this state, the conveyance screw 53 and the agitator 54 are not cooperatively driven. Therefore, the condensing load, which is caused by excessive feeding of the toner toward the return opening 24, is prevented from being applied to the toner. Hereinafter a detailed reason is described. When the discharge opening 52 is closed, if the conveyance screw 53 and agitator 54 are cooperatively driven, the condensing load to the toner may be exceeded than the reduction effort by the return opening 24. The amount of the toner fed toward the return opening 24 may exceed the returnable amount. However, in the first embodiment, the toner conveyance screw 53 and the agitator 54 have configurations such that they are not cooperatively driven when the toner cartridge 50 is detached from the apparatus main body 100. Therefore, the condensing load, which is caused by excessive feeding of the toner toward the return opening 24, is prevented from being applied to the toner.

As described above, according to the first embodiment of the present invention, failures caused by users' unconscious rotation of the conveyance screw 53 in the state where the toner cartridge 50 is detached from the apparatus main body 100, such as deterioration of the toner and damages to the components, can be suppressed. Therefore, a high-quality and highly reliable image forming apparatus can be provided.

In the above-described embodiment, the case where the user or the like rotates the conveying drive gear 62 has been explained as an example. However, when the agitating drive gear 63 is exposed from the gear cover 57, for the convenience of the layout, for example, the agitating drive gear 63 may be driven. In such a case, the agitator is rotated, but the rotation of the conveyance screw 53 can be avoided. Therefore, the toner can be prevented from being fed to the vicinity of the discharge opening 52, which is a narrow cylindrical space, and to the return opening 24, and the load, which is caused by the conveyance screw 53 being driven when the toner cartridge 50 has been detached from the apparatus main body 100, can be prevented from being applied to the toner.

Further, the image forming apparatus according to the first embodiment demonstrates the following functions and effects. The return openings 24 and 67 function not only in a state where the toner cartridge 50 is detached from the main body 100 but also in a state where the toner cartridge 50 is attached to the apparatus main body 100. Namely, as shown in FIG. 9A, even when the toner cartridge 50 is attached to the apparatus main body 100 and the discharge opening 52 is opened, the portion of the return opening 24 of the internal shutter 22 overlaps with the second return opening 67 of the roof portion 65. Thus, the toner inside the internal shutter 22 can be returned through the return openings 24 and 67. Especially, while the discharge opening 52 is being clogged, it is possible that the toner is accumulated and the load is applied. Even in such a case, the toner can be returned to the toner storing space 51 through the return openings 24 and 67, and thereby the load applied to the toner can be decreased. In this manner, even in the state where the toner cartridge 50 is attached to the apparatus main body 100, the failures such as the deterioration of the toner and the damages to the components can be suppressed.

Figure 24:
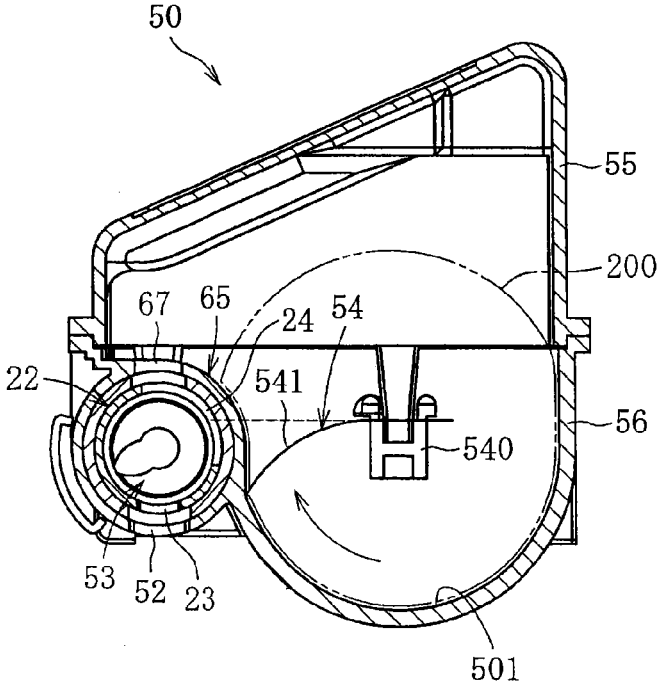
FIG. 24 is a diagram illustrating a position where a return opening is provided.

Further, it is preferable that the position where the second return opening 67 is formed in the roof portion 65 is located outside the agitating region 200 of the agitator 54, as shown in FIG. 24. When the second return opening 67 is disposed within the agitating region 200, specifically, when the second return opening 67 is disposed on the peripheral wall at the right side of the roof portion 65, it is possible that the toner discharged from the second return opening 67 is pushed back by the agitator 54. Therefore, by disposing the second return opening 67 outside the agitating region 200, the toner can be smoothly discharged to the toner storing space 51 through the second return opening 67.

Figure 25:
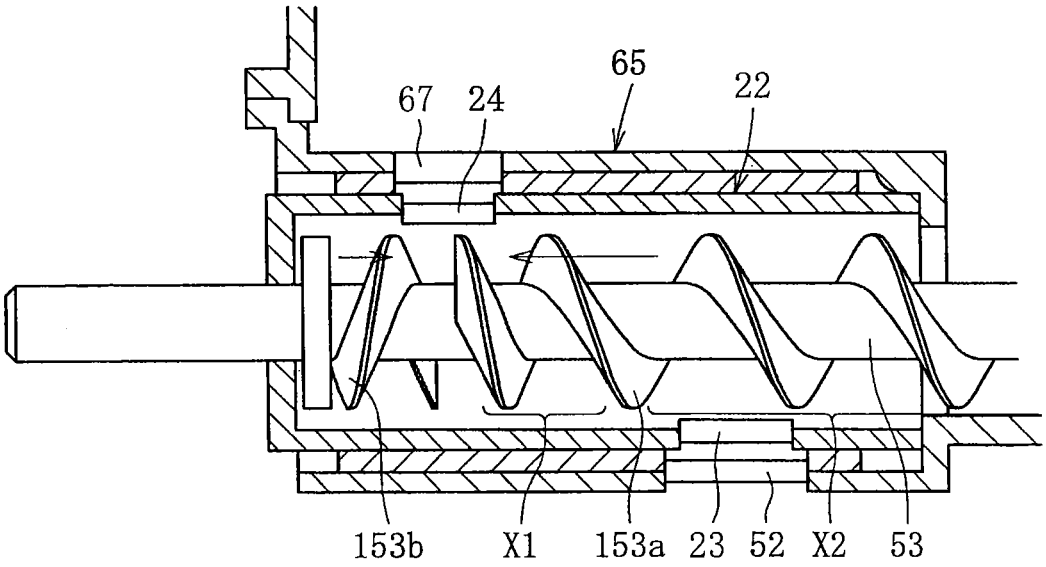
FIG. 25 is a diagram showing another embodiment of the conveyance screw.

Further, as shown in FIG. 25, the direction of the blade 153*b* on an end portion of the conveyance screw 53 at a downstream side in the toner conveyance direction may be set to be opposite to the direction of the blade 153 on the portion of the conveyance screw 53 other than the end portion, so that the toner is returned from the end portion of the conveyance screw 53 in the toner conveyance direction to the return opening 24. With this configuration, a flow is generated at the side closer to the end portion of the conveyance screw 53 than the return opening. The flow actively returns the toner that has passed through the return opening 24 back into the return opening 24. As a consequence, the accumulation of the toner at the side of the end portion can be suppressed, and damages to the conveyance screw 53 or to the container body 70 due to the load from the accumulated toner can be avoided.

Further, in the example shown in FIG. 25, a first pitch of the blade 153*a* at a first portion X1 between the return opening 24 and the inner opening 23 is set to be smaller than a second pitch of the blade 153*a* at a second portion X2 at an upstream side of the inner opening 23 in the toner conveyance direction. With this configuration, the toner conveyance speed at the downstream side of the discharge opening 52 becomes slower than the toner conveyance speed at the upstream side of the discharge opening 52. The toner passing the discharge opening 52 is jammed and the following toner is facilitated to go out from the discharge opening 52.

Further, in the first embodiment, the torque transmission gear 64 is movable between the operating position shown in FIG. 19B and the retracted position shown in FIG. 19C, as explained above. Therefore, the horizontal protrusion 101 of the apparatus main body 100 is prevented from interfering with the torque transmission gear 64 during the attaching operation and the detaching operation of the toner cartridge 50. As a consequence, a part of the container guiding portion 73*a* or all the container guiding portion 73*a* can be disposed at the operating position of the torque transmission gear 64 (within the projected area J shown in FIG. 14), thereby improving the degree of freedom on designing the layout of the guide mechanism of the toner cartridge 50, compared to that of the conventional cases.

For example, in a conventional configuration of the toner cartridge 50 having the sequence of the plural gears 62, 63, and 64, which are connected as shown in FIG. 14, it is required to dispose the groove 73 at the left side in the figure with respect to the projected area of the conveying drive gear 62 or at the right side in the figure with respect to the projected area of the agitating drive gear 63, so as to arrange the groove 73 while avoiding the sequence of the gears. Alternatively, the sequence of the gears may be disposed as the groove 73 overlaps the sequence of the gears by extending the length of the toner cartridge 50 in the longitudinal direction Q. The above two types of arrangements are accompanied by the growth in the size of the toner cartridge 50, which is not related to the storage volume of the toner cartridge 50. Thus, the product may become less attractive by adopting such an arrangement.

On the other hand, with the configuration according to the first embodiment, the groove 73 can be disposed at a space between the projected area of the conveying drive gear 62 and the projected area of the agitating drive gear 63. In such a configuration, it looks as if the groove 73 and the sequence of the gears were overlapped, when the groove 73 and the sequence of the gears are viewed in the longitudinal direction of the toner cartridge 50. With the configuration according to the first embodiment, the degree of freedom on designing the layout of the guide mechanism is improved, and the toner cartridge 50 can be downsized compared to a toner cartridge having a conventional configuration.

Especially, in the configuration of the first embodiment shown in FIG. 14, it may be required to arrange the groove 73 as if the groove 73 penetrated the sequence of the gears, based on the following reasons. First, in the case of the configuration shown in FIG. 14, it is preferable that the disposed position of the information storing medium 58 be at an upper portion of the toner cartridge 50 (the position that is separated from the discharge opening 52 in the diagonal direction, when the shape of the gear cover 57 is regarded substantially as a rectangle shape), which is far from the discharge opening 52, so that it becomes difficult to dirty the terminal surface of the information recording medium 58 with the toner. Second, it is preferable that the disposed position of the container positioning portion 73*b* of the groove 73 be in the vicinity of the information recording medium 58, so as to improve the positioning accuracy of the information recording medium 58. Consequently, the container positioning portion 73*b* of the groove 73 is disposed at an area above the sequence of the gears. Thus, in the scheme in which the toner cartridge 50 is attached to and detached from the apparatus main body 100 in the vertical direction, as in the case of the first embodiment, the groove 73 may be required to be extended downwardly from the area above the sequence of the gears. Consequently, the groove 73 is arranged as if the groove 73 penetrated the sequence of the gears.

Especially, by applying the configuration according to the first embodiment, for example, to the configuration shown in FIG. 14, the groove 73 can be disposed at the space between the projected area of the conveying drive gear 62 and the projected area of the agitating drive gear 63. Therefore, the downsizing of the toner cartridge can be expected.

Further, as described above, in the configuration according to the first embodiment, the positioning accuracy of the information storing medium 58 with respect to the contacting terminals of the information reading device disposed in the apparatus main body 100 is improved by arranging the container positioning portion 73*b* in the vicinity of the information storing medium 58. With this, the electrical connection between the information storing medium 58 and the information reading device can be ensured. In addition, since the positioning accuracy of the information storing medium 58 is improved, the sizes of the contacting terminals of the information storing medium 58 and those of the information reading device can be reduced. Usually, gold plating has been applied to such contacting terminals, so as to prevent the contacting terminals from being corroded. By reducing the sizes of the contacting terminals, the amount of the gold plating can be decreased, and thereby the producing cost can be reduced.

Further, in the first embodiment, the positioning unit formed on the front side of the gear cover 57 for positioning the toner cartridge 50 with respect to the apparatus main body 100 (the container positioning portion 73*b* of the groove 73 and the positioning convex 79) and the positioning unit formed on the rear side of the gear cover 57 for positioning the gear cover 57 with respect to the case 55 and 56 are disposed at the same positions or at almost the same positions on the front side and on the rear side of the gear cover 57. In addition, the positioning convex 79 on the front side and the hole 78 on the rear side are the main reference positions of the corresponding positioning portions of the main body. The container positioning portion 73*b* on the front side and the boss 76 in the vicinity of the position of the container positioning portion 73*b* on the rear side are the sub-reference positions of the corresponding positioning portions of the main body. In this manner, in the first embodiment, the main reference positions for the positioning on the front side of the gear cover 57 and for the positioning on the rear side of the gear cover 57 are arranged at the same corresponding positions on the front side and on the rear side. Similarly, the sub-reference positions for the positioning on the front side of the gear cover 57 and for the positioning on the rear side of the gear cover 57 are arranged at almost the same corresponding positions on the front side and on the rear side. When the paper surfaces of FIG. 19A through FIG. 19C are regarded as reference planes, the distance between the two main reference positions is minimized (equal to 0 mm) because both center spots of the two main reference positions are same. Similarly, the distance between the two sub-reference positions is minimized (almost equal to 0 mm). The gear cover 57 has been adopted so as to protect the gears. However, with the above configuration, the effect of adopting the gear cover 57, namely, variations in dimensions during the positioning of the container body 70 with respect to the apparatus main body 100 through the gear cover 57 can be suppressed. Consequently, even if the toner cartridges 50 are produced in a large quantity, all the produced toner cartridges 50 can be accurately positioned with respect to the corresponding device main bodies 100.

Further, in the first embodiment, since the lower end of the groove 73 of the toner cartridge 50 has a large width, the horizontal protrusion 101 can be easily inserted into the groove 73 from the lower end. In addition, the groove 73 is formed so that the width of the groove 73 gradually becomes smaller toward the container positioning portion 73*b*. Therefore, the horizontal protrusion 101 can be smoothly guided to the container positioning portion 73*b*, and the toner cartridge 50 can be accurately positioned with respect to the apparatus main body 100 by the fit between the container positioning portion 73*b* having the small width and the horizontal protrusion 101 at the position of the container positioning portion 73*b*.

Further, in the first embodiment, the timing at which the internal shutter 22 is opened is set to be after the completion of mounting the toner cartridge 50. With such a setting, the toner can be prevented from scattering from the toner cartridge 50. Namely, when the toner cartridge 50 is to be mounted on the apparatus main body 100, the external shutter 60 is opened in accordance with the mounting operation, while the internal shutter 22 is still closed. Therefore, the toner is prevented from being scattered prior to the connection between the discharge opening 52 and the supply opening 49 being established. The timing of opening the external shutter 60 is set to be the timing prior to the completion of the mounting of the toner cartridge 50 so as to avoid the interference between the external shutter 60 and the supply opening 49 during the mounting operation.

Further, when the toner cartridge 50 is removed from the apparatus main body 100, the internal shutter 22 is closed at the time at which the toner cartridge 50 is still mounted on the apparatus main body 100. In this manner, the internal toner can be prevented from scattering during the removing operation. In addition, since the external shutter 60 is closed in accordance with the removing operation, even if the toner has been adhered inside the discharge opening 52, the toner is not scattered. In this manner, in the first embodiment, by adopting the double shutter structure including the internal shutter 22 and the external shutter 60, the scattering of the toner from the discharge opening 52 during the attaching operation and the detaching operation of the toner cartridge 50 is surely prevented.

Further, in the first embodiment, when the toner cartridge 50 is to be removed from the apparatus main body 100, since the external shutter 60 automatically closes the discharge opening 52 in accordance with the removing operation, the leakage of the toner and the scattering of the toner from the discharge opening 52, which are caused by the external shutter 60 being left open, can be prevented.

Incidentally, a configuration has conventionally been known in which a rack and pinion mechanism is adopted as a driving unit for driving a cylindrical rotational shutter in accordance with an attaching operation and a detaching operation of a toner cartridge (cf. Japanese Patent Laid-Open No. 2009-42567). However, in this case, there is a problem that the guide unit of the toner cartridge may be required to be formed with a high precision, so that the rack and the pinion smoothly engages with each other during the attaching operation of the toner cartridge.

Contrary to this, in the first embodiment, it suffices that the apparatus main body protrusion 102 pushes up the gear holder protrusion 71*b*. Here, the gear holder protrusion 71*b* is integrally formed with the external shutter 60. Therefore, the position of the apparatus main body protrusion 102 can be roughly set. Further, a guide unit for guiding the toner cartridge during an attaching operation may have a simple configuration. Therefore, the configuration according to the first embodiment is simpler than the configuration in which the conventional rack and pinion mechanism is utilized.

The tension spring 26 and the moving member 113 shown in FIG. 11 are utilized as the driving unit of the internal shutter 22. On the other hand, the tension spring 72 and the apparatus main body protrusion 102 shown in FIGS. 19A-19C are utilized as the driving unit of the external shutter 60. Namely, in the first embodiment, the driving unit of the internal shutter 22 and the driving unit of the external shutter 60 are provided as different individual driving units. Thus, in case one of the internal shutter 22 and the external shutter 60 does not operate due to an erroneous operation during the replacing operation of the toner cartridge 50 or a malfunction of the apparatus main body 100, the other shutter operates, and thereby the discharge opening 52 can be closed. In this manner, the likelihood that the toner is scattered from the discharge opening 52 due to malfunctioning of both the internal shutter 22 and the external shutter 60 can be lowered.

Figure 26:
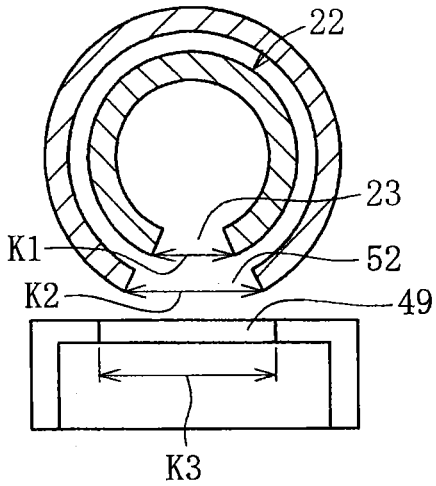
FIG. 26 is a diagram showing a relationship among widths of an developer discharging opening, the discharge opening, and the supply opening.

In FIG. 26, the width of the inner opening 23 formed in the internal shutter 22 is indicated as K1. The width of the discharge opening 52 is indicated as K2. The width of the supply opening 49 is indicated as K3. It is preferable that K1, K2, and K3 satisfy the inequality K1<K2<K3. By adjusting the relationship among the widths of the openings K1, K2, and K3, it can be ensured that the toner is supplied to the supply opening 49.

Figure 27:
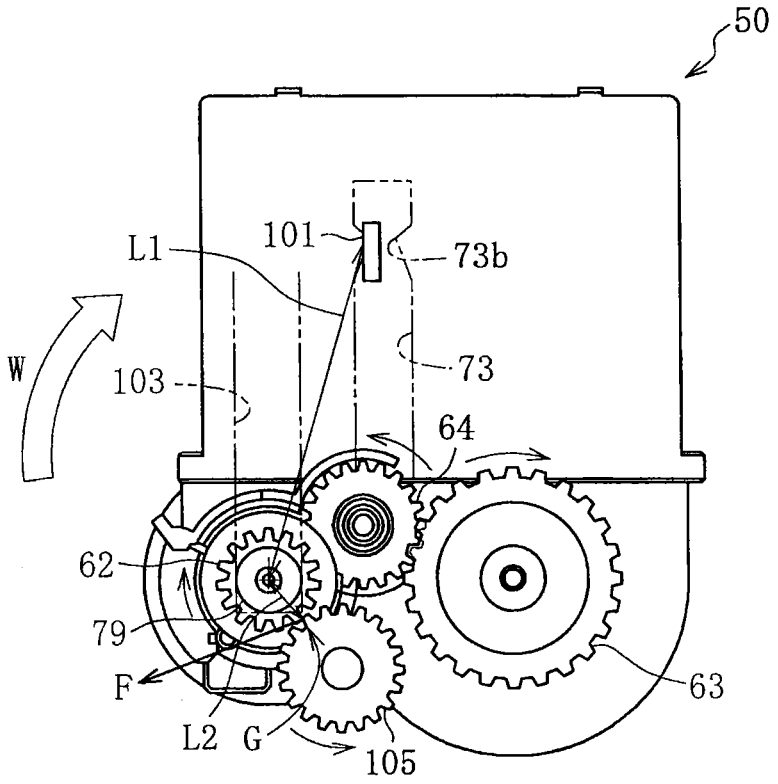
FIG. 27 is a diagram illustrating a force applied to the toner cartridge.

FIG. 27 is a diagram showing a force applied to the toner cartridge 50 during transmission of a rotational torque. As shown in FIG. 27, when the main body side drive gear 105 rotates in the counterclockwise direction in the figure, a force is generated in the direction indicated by the arrow F at a torque transmitting spot G where the main body side drive gear 105 engages with the conveying drive gear 62. Then, a rotational load, which is applied to the conveying drive gear 62 when the toner stored inside the toner cartridge 50 is agitated and conveyed, resists the force F. Consequently, a torque (moment) in the direction indicated by the arrow W is applied to the whole toner cartridge 50. Here, the torque is centered on the positioning convex 79, which has been positioned in place. However, as described above, since the movement of the toner cartridge 50 in the rotational direction centered on the positioning convex 79 is regulated by the fit between the horizontal protrusion 101 and the container positioning portion 73*b* of the groove 73, the toner cartridge 50 is not rotated by the torque. Especially, in the first embodiment, a length L1 from the center of the positioning convex 79 to a portion at which the protruding portion receives the acting force (one of a pair of portions included in the container positioning portion 73*b*, which is closer to the positioning convex 79), is about 6.4 times as much as a length L2 from the center of the positioning convex 79 to the torque transmitting spot G. Thus, the length L1 is sufficiently large, and, consequently, a rotation resistant property (positional stability) of the toner cartridge 50 is fine. Inside the gear cover 57, a passing area is provided, at which the torque transmission gear 64 passes through when the torque transmission gear 64 is moved. However, across the passing area, the container guiding portion 73*a* is extended vertically downward from the container positioning portion 73*b* disposed above, and the entrance portion where the horizontal protrusion 101 of the apparatus main body 100 is inserted into is disposed in the vicinity of the bottom portion of the toner cartridge 50 (the space between the conveying drive gear 62 and the agitating drive gear 63). With this configuration, when the user attaches the toner cartridge 50 to the apparatus main body 100, the user can easily fit the horizontal protrusion 101 into the entrance portion of the container guiding portion 73*a*, and the user can smoothly perform the subsequent setting operations. Such a rotation resistant property and ease of attaching the toner cartridge 50 to the apparatus main body 100 are attributable to the positional relationship among the positioning convex 79 (namely, the center of the conveying drive gear 62, whish is related to the external shutter 60), the container positioning portion 73*b*, and the container guiding portion 73*a*. The moving mechanism establishes the positional arrangement of the torque transmission gear 64 such that the torque transmission gear 64 does not interfere with the positioning convex 79, the container positioning portion 73*b*, and the container guiding portion 73*a*. The embodiment of the present invention has been developed in conjunction with the moving mechanism.

Figure 28:
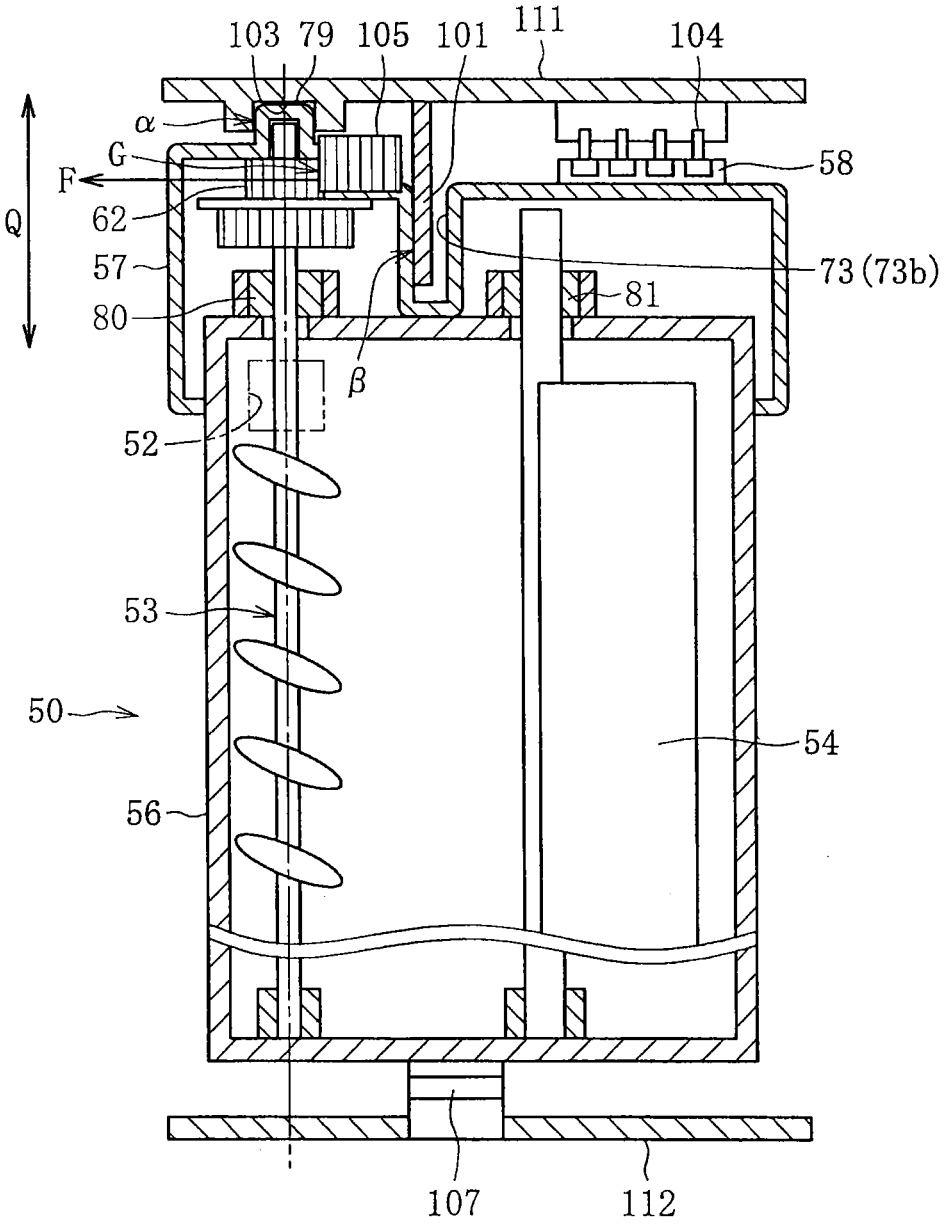
FIG. 28 is a cross-sectional view of the toner cartridge in a state where the toner cartridge is attached to the main body of the image forming apparatus, viewed from a bottom side of the toner cartridge.

FIG. 28 is a cross-sectional view of the toner cartridge 50, when the toner cartridge 50 is attached to the apparatus main body 100 and viewed from a bottom side. As shown in FIG. 28, the torque transmitting spot G of the conveying transmission gear 62 is disposed at a position between a spot α that has been positioned in place by the main body groove 103 and the positioning convex 79 and a spot β that has been positioned in place by the container positioning portion 73*b* on the toner cartridge 50 and the horizontal protrusion 101 of the apparatus main body 100 in the longitudinal direction Q of the toner cartridge 50 (or the direction of the rotational shaft 530 of the conveyance screw 53). Namely, on the gear cover 57, the positioning convex 79 is disposed at one side and the container positioning portion 73*b* is disposed at the opposite side via the torque transmitting spot G, which can be regarded as a reference position, in the longitudinal direction Q.

Figure 29:
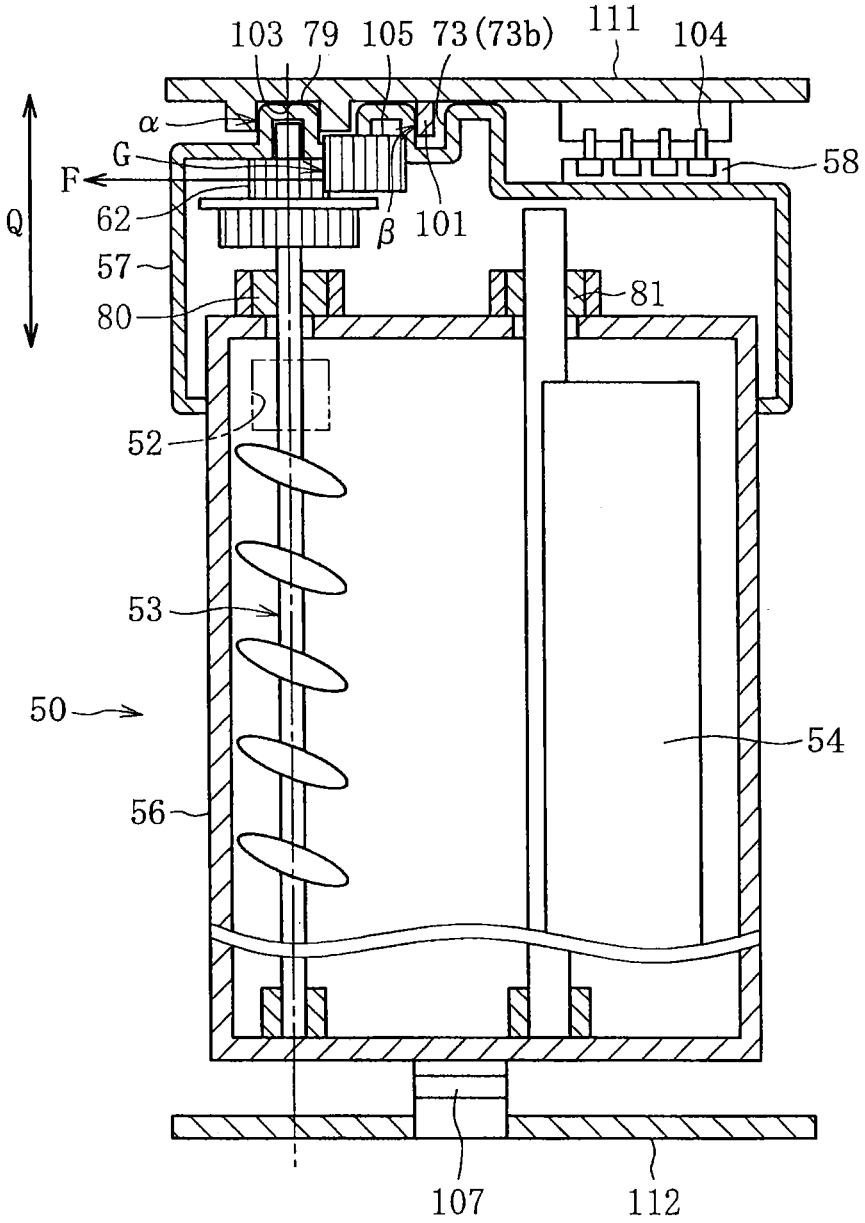
FIG. 29 is a cross-sectional view of a toner cartridge according to a comparative example in a state where the toner cartridge is attached to the image forming apparatus, viewed from a bottom side of the toner cartridge.

FIG. 29 is a cross-sectional view of a toner cartridge according to a comparative example, which is attached to the apparatus main body 100 and viewed from a bottom side. Unlike the above-described embodiment, in the comparative example, the spot α that has been positioned in place by the main body groove 103 and the positioning convex 79 and the spot β that has been positioned in place by the container positioning portion 73*b* on the toner cartridge 50 and the horizontal protrusion 101 of the apparatus main body 100 are disposed at the same side (the upper side in the figure) in the longitudinal direction Q of the toner cartridge 50 with respect to the torque transmitting spot G of the conveying drive gear 62. The configuration is the same as that of the above-described embodiment, except for that. Namely, in the comparative example shown in FIG. 29, the toner cartridge 50 is positioned in place by one side in the longitudinal direction Q.

In this case, when a force in the direction indicated by the arrow F is generated at the torque transmitting spot G by the rotation of the main body side drive gear 105, since the toner cartridge 50 is positioned in place by the one side in the longitudinal direction Q with respect to the torque transmitting spot G, it is possible that the toner cartridge 50 is twisted between one end and the other end of the toner cartridge 50 in the longitudinal direction Q. Especially, in the toner cartridge 50 according to the embodiment, the end that is opposite to the end where the sequence of the gears are disposed is not positioned in place, but the end is only biased by the biasing member 107 in the longitudinal direction Q. Therefore, it is likely that the position of the toner cartridge 50 is shifted at the side of the end in the direction which crosses the longitudinal direction Q.

In the first embodiment, the container positioning portions (the positioned spots α and β) are disposed at both sides in the longitudinal direction Q with respect to the torque transmitting spot G, as shown in FIG. 28. Therefore, even if the toner cartridge 50 receives the force F at the torque transmitting spot G, the toner cartridge 50 can effectively suppress that the toner cartridge 50 is twisted between one end and the other end in the longitudinal direction Q of the toner cartridge 50. With this configuration, the toner cartridge 50 can be positioned with respect to the apparatus main body 100 with a high precision.

Second Embodiment

FIGS. 30 through 33 show a configuration of the image forming apparatus according to a second embodiment. Hereinafter, portions of the image forming apparatus according to the second embodiment that are different from the corresponding portions of the image forming apparatus according to the first embodiment are explained.

Figure 30:
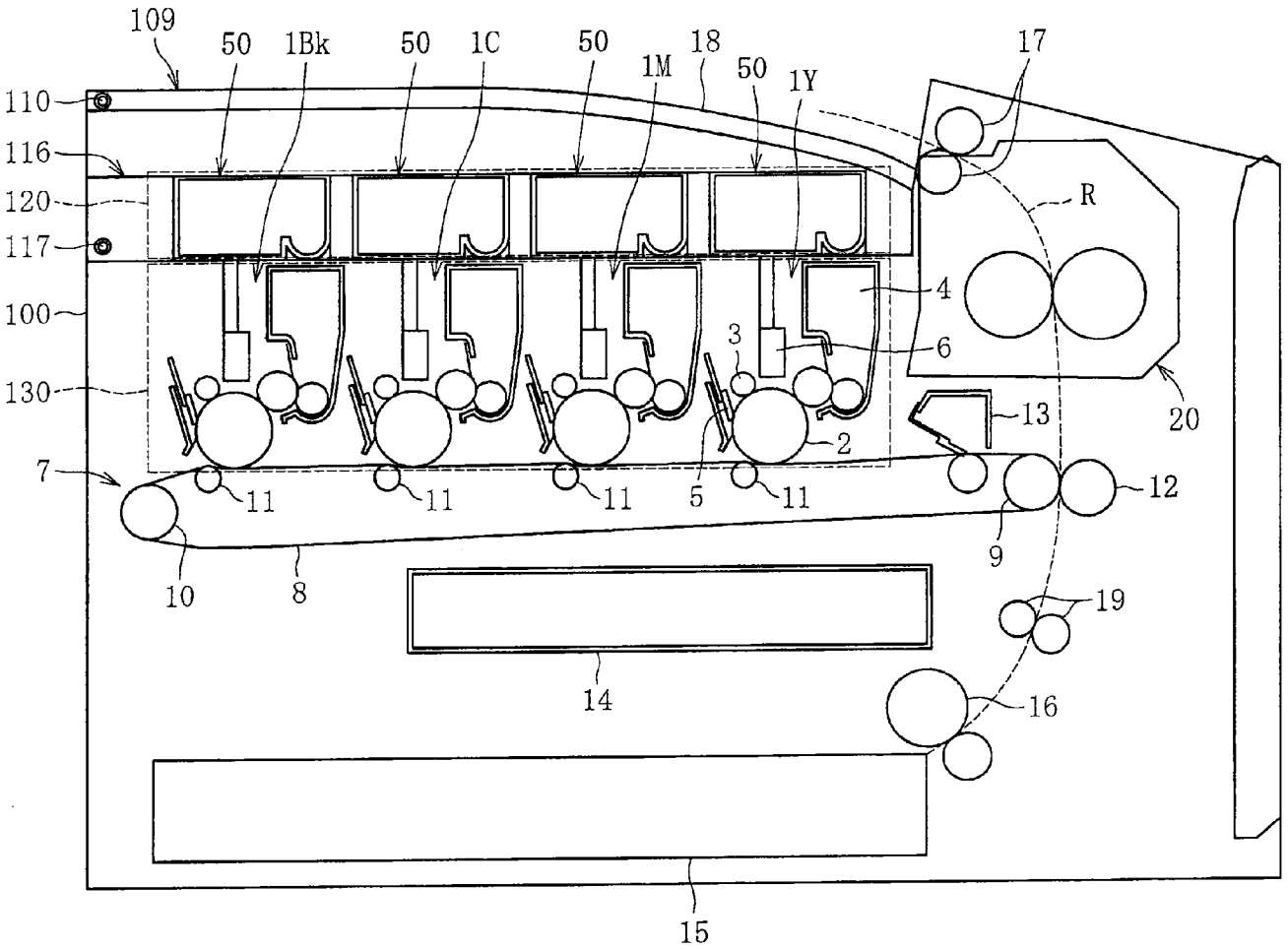
FIG. 30 is a schematic configuration diagram of an image forming apparatus according to another embodiment of the present invention.
Figure 31:
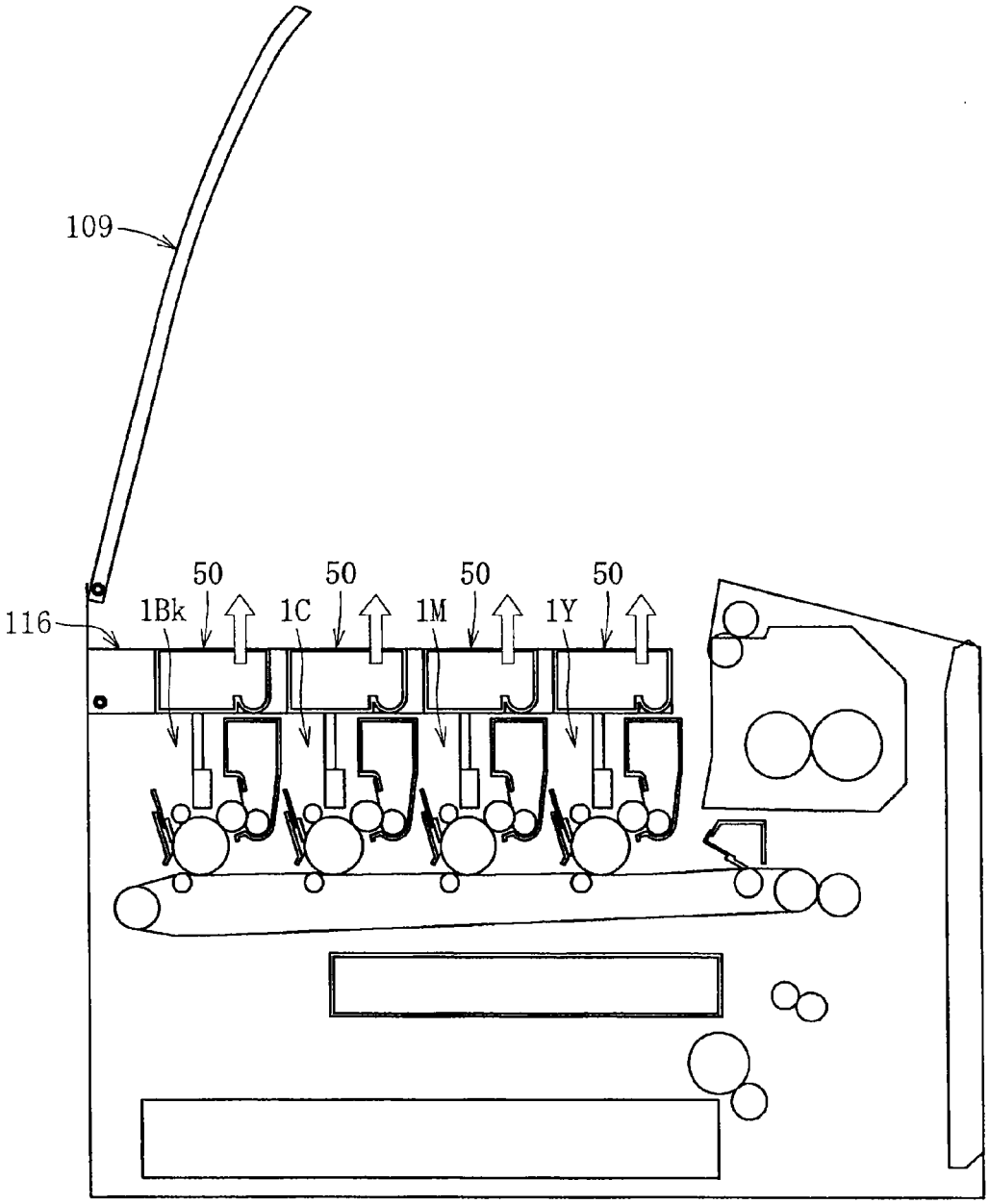
FIG. 31 is a diagram showing a state where an upper cover is opened.
Figure 32:
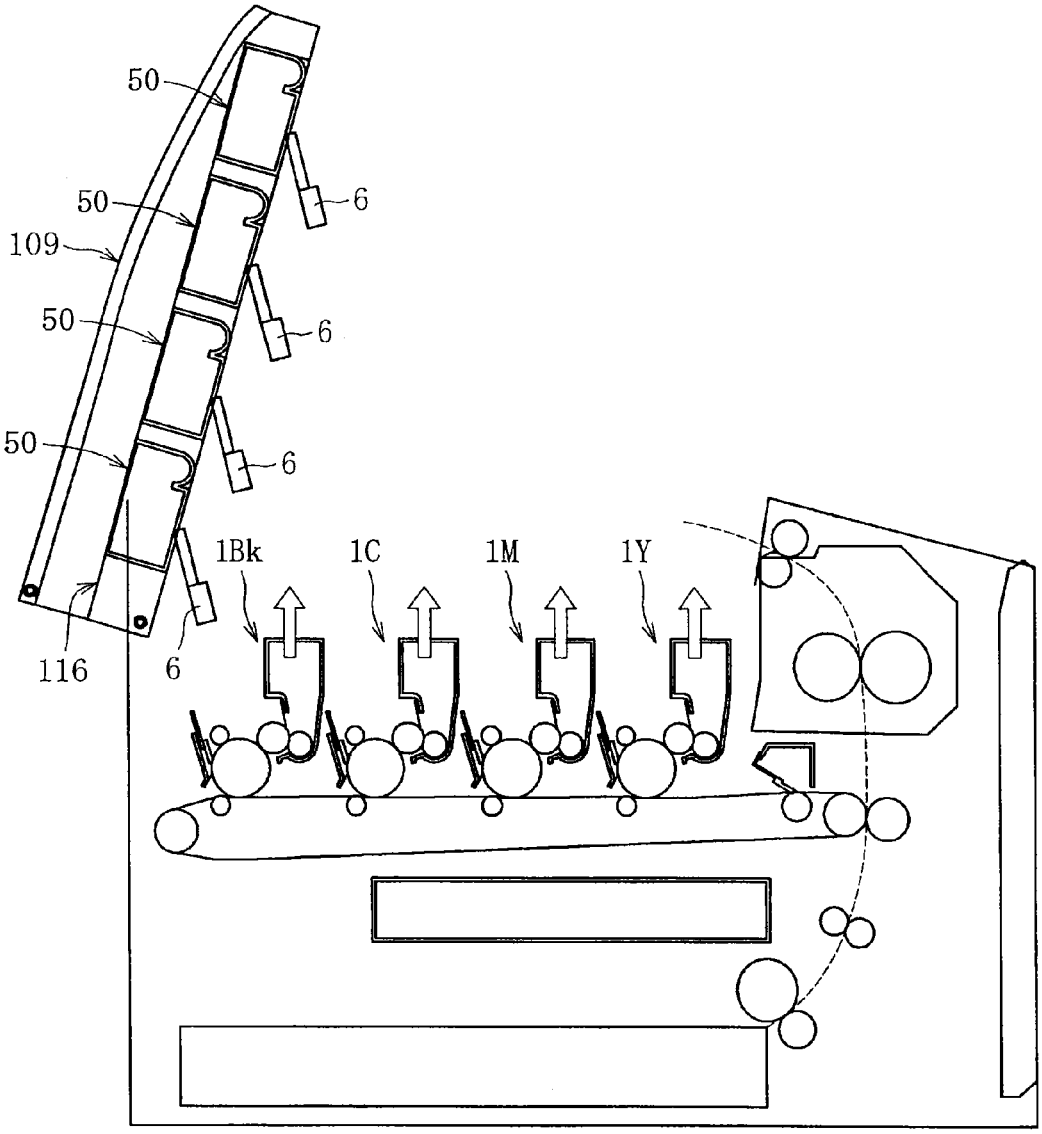
FIG. 32 is a diagram showing a state where the upper cover and an internal cover are opened.

As shown in FIG. 30, the image forming apparatus includes an upper cover 109 as a first cover that is disposed at an upper portion of the apparatus main body 100; a container mounting portion 120 on which the toner cartridges 50 can be mounted when the upper cover 109 is opened; an internal cover 116 as a second cover that is disposed inside the apparatus main body 100 (below the container mounting portion 120) and that is openable and closeable; and a unit mounting portion 130 to which the process units 1Y, 1M, 1C, and 1Bk can be detachably attached when the internal cover 116 is opened. FIG. 31 shows a state of the image forming apparatus where the upper cover 109 is opened. FIG. 32 shows a state of the image forming apparatus where the internal cover 116 is opened.

Specifically, the internal cover 116 is attached to the apparatus main body 100, so that the internal cover 116 is openable and closeable in the vertical direction when the internal cover pivots with respect to the apparatus main body 100 while being centered on a fulcrum 117. The toner cartridges 50 storing yellow toner, magenta toner, cyan toner, and black toner, respectively, can be mounted on the internal cover 116. Similar to the first embodiment, plural mounting portions 106 (cf. FIG. 15) for mounting the toner cartridges 50 for the corresponding colors are formed on an upper surface of the internal cover 116 (the mounting portions 106 are not shown in FIGS. 30-32). As shown in FIG. 31, in the state where the upper cover 109 is opened, the toner cartridges 50 can be attached to and detached from the apparatus main body 100.

As well as the first embodiment, the external shutter 60 of the second embodiment also starts to be opened by the pushing up of the apparatus main body protrusion 102 in the middle of mounting operation of the toner cartridge 50, as described in FIG. 19C. Further, as well as the first embodiment, when the upper cover 109 is closed, the internal shutter 22 of the second embodiment is opened by the moving member 113 (not shown in FIG. 30-32), which is driven by the driving unit such as a solenoid or a cam mechanism, as described in FIG. 10B.

The process units 1Y, 1M, 1C, and 1Bk for the corresponding colors are stored inside (below) the internal cover 116. Therefore, when the process units 1Y, 1M, 1C, and 1Bk are attached or detached, both the upper cover 109 and the internal cover 116 are opened, as shown in FIG. 32. Further, plural exposure units 6 (LED units) for exposing the corresponding photoconductors 2 are swingably held on a bottom surface of the internal cover 116. The exposure units 6 are moved by a guiding unit (not shown) between closer positions in the vicinity of the corresponding photoconductors 2 and retracted positions disposed above the corresponding closer positions in accordance with an opening operation and a closing operation of the internal cover 116, while avoiding interfering with the process units 1Y, 1M, 1C, and 1Bk.

With the above-described configuration, when the internal cover 116 is opened, the toner cartridges 50 can be retracted from upper positions of the corresponding process units 1Y, 1M, 1C, and 1Bk, while the toner cartridges 50 are kept attached to the internal cover 116. Therefore, the process units 1Y, 1M, 1C, and 1Bk can be attached to and detached from the device main body without removing the toner cartridges 50. In this manner, operability during replacing processes of the process units 50 can be improved, and the likelihood that the toner is scattered from the toner cartridges 50 into the apparatus main body 100 can be lowered.

On the other hand, in the state of the image forming apparatus where the internal cover 116 is closed, it is not possible to visually recognize the process units 1Y, 1M, 1C, and 1Bk. Therefore, when the process units for the corresponding plural colors are to be simultaneously replaced, it is possible that the upper cover 109 and the internal cover 116 are closed, without attaching some of the process units. In case the process units are not attached, the toner will be scattered in the apparatus main body 100, when the discharge openings 52 of the corresponding toner cartridges 50 are opened.

Figure 33:
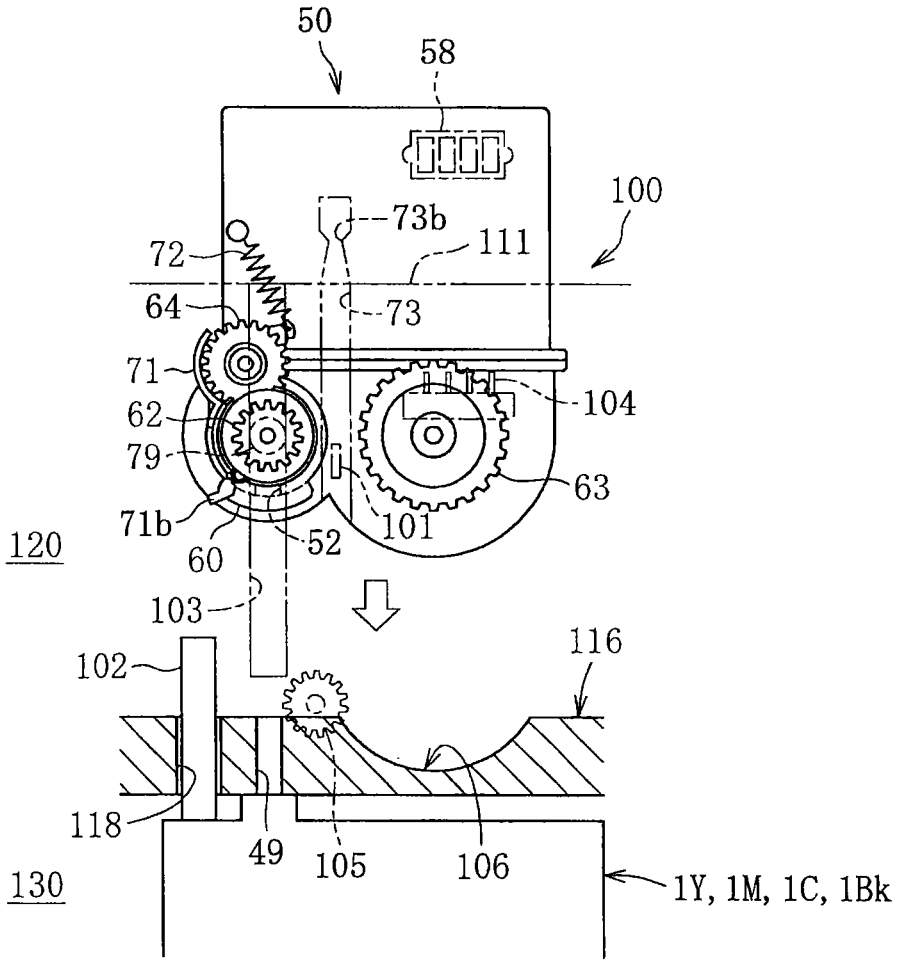
FIG. 33 is a diagram showing a configuration where an apparatus main body protrusion is attached to a process unit.

In order to prevent such scattering of the toner, as shown in FIG. 33, the apparatus main body protrusions 102 for opening the corresponding external shutters 60 are provided on the corresponding process units 1Y, 1M, 1C, and 1Bk. Accordingly, insertion holes 118 for inserting the corresponding apparatus main body portions 102 are formed in the internal cover 116. With this configuration, when the process units 1Y, 1M, 1C, and 1Bk are attached to the apparatus main body 100 and the internal cover 116 is closed, the apparatus main body protrusions 102 are inserted into the corresponding insertion holes 118 of the internal cover 116.

With such a configuration, the apparatus main body protrusion 102 for opening the external shutter 60 does not exist at a portion on which the process unit is not mounted. Therefore, when the internal cover 116 is closed without attaching a process unit, the external shutter 60 is not opened at the portion on which the process unit is not mounted. Thus, the scattering of the toner can be prevented.

Each of the insertion holes 118 formed in the internal cover 116 has a size that is sufficient for inserting the apparatus main body protrusion 102. Namely, in this case, the size of the insertion hole 118 can be reduced, compared to a case where a conventional configuration, in which the above-described rack and pinion mechanism is adopted, is implemented. Therefore, sufficient strength of the internal cover 116 can be ensured.

The second embodiment of the present invention has been explained above, based on FIGS. 30-33. However, for the components of the configuration according to the second embodiment which are the same as the corresponding components of the configuration according to the first embodiment, the same functions and the same effects can be obtained.

According to the above embodiments, at least, the following configurations are disclosed.

A developer container is detachably attached to an image forming apparatus main body. The developer container includes a container body configured to store developer;

a discharge opening configured to discharge the developer inside the container body to a developing device;

a rotator configured to be rotationally driven in the container body; and a sequence of gears disposed on an external side of the container body, the sequence of gears including plural gears configured to transmit a driving torque to the rotator, wherein the container body includes a developer storing space configured to store the developer; and a developer conveyance passage configured to guide the developer stored in the container body toward the discharge opening, wherein the rotator includes a conveyor disposed inside the developer conveyance passage and configured to convey the developer to the discharge opening; and an agitator disposed inside the developer storing space and configured to agitate the developer, wherein the sequence of gears includes a driving force transmitter configured to interlock the conveyor with the agitator, wherein, when the developer container is detached from a mounting portion of the image forming apparatus main body, the driving force transmitter is configured to release interlocking between the conveyor and the agitator, and wherein the developer container further includes a first return opening configured to return the developer, which has not been discharged from the discharge opening, from the developer conveyance passage to the developer storing space.

The driving force transmitter may include a conveying drive gear attached to the conveyor;

an agitating drive gear attached to the agitator; and a torque transmission gear configured to engage with the conveying drive gear and the agitating drive gear and configured to transmit a rotational torque.

The torque transmission gear may be configured to be moved between an operating position where the torque transmission gear engages with the agitating drive gear and transmits the torque and an retracted position where the torque transmission gear is retracted from the operating position.

The container body may include an internal shutter disposed inside the container body and having a cylindrical shape, the internal shutter including an inner opening disposed on a circumferential wall of the internal shutter and configured to discharge the developer.

When the internal shutter pivots around an axis of the cylindrical shape, the internal shutter is configured to switch between an open state where the inner opening of the internal shutter overlaps with the discharge opening and a closed state where the circumferential wall of the internal shutter overlaps with the discharge opening.

The first return opening may be disposed on the circumferential wall of the internal shutter.

The inner opening may be disposed at an upstream side of the first return opening in a developer conveyance direction.

The container body may include a roof portion disposed on an outer circumferential side of the internal shutter and configured to rotatably support the internal shutter.

In the roof portion, a second return opening may be formed.

The first return opening may be extended in a circumferential direction of the internal shutter so that apart of the first return opening overlaps with the second return opening, regardless of whether the discharge opening is opened or closed by the internal shutter.

The second return opening may be disposed outside an agitating region of the agitator.

The developer container may further includes a first biasing member disposed between the developer container and the internal shutter and configured to apply a first bias force to the internal shutter in a direction to close the discharge opening. The internal shutter may be arranged in the mounting portion so as to be abutted by a moving member movably disposed in the image forming apparatus main body. With such a configuration, when the moving member abuts the internal shutter and causes the internal shutter to be pivoted, the internal shutter is switched to the open state.

In the developer container, the container body may include an external shutter disposed on an outer side of the container body and configured to open and close the discharge opening.

The external shutter may engage with a second biasing member configured to apply a second bias force to the external shutter in a direction to close the discharge opening.

The external shutter may include a pushed portion configured to be pushed by a main body side pushing portion disposed in the mounting portion of the apparatus main body, when the developer container is attached to the mounting portion.

The discharge opening may be configured to be opened, when the main body side pushing portion pushes the pushed portion of the external shutter and drives the external shutter.

The developer container may further include an internal shutter disposed inside the container body and configured to open and close the discharge opening; and an external shutter disposed outside the container body and configured to open and close the discharge opening.

The internal shutter may be configured to be driven by a first driving unit and the external shutter may be configured to be driven by a second driving unit, the first driving unit and the second driving unit being different from each other.

With such a configuration, when the container body is attached to the image forming apparatus main body, the external shutter is opened in accordance with an attaching operation, and subsequently the internal shutter is opened after the attaching operation is completed.

Further, when the container body is detached from the image forming apparatus main body, the internal shutter is closed while the container body is still attached to the main body, and subsequently the external shutter is closed in accordance with a detaching operation.

The developer container may further include an external shutter disposed outside the container body and configured to open and close the discharge opening.

The external shutter may be configured to move the torque transmission gear to the operating position in accordance with an operation to open the discharge opening.

The external shutter may be configured to move the torque transmission gear to the retracted position in accordance with an operation to close the discharge opening.

In the developer container, a first width K1 of the inner opening formed in the internal shutter, a second width K2 of the discharge opening and a third width K3 of a supply opening of the developing device configured to be connectable to the discharge opening may satisfy an inequality K1<K2<K3.

According to the embodiments, there is provided a developing device which operates in an image forming apparatus. The developing device includes a developer housing configured to store developer;

a developer supporting body configured to support the developer inside the developer housing and configured to supply the developer to a latent image on a latent image supporting body in the image forming apparatus;

a mounting portion formed on the developing device; and the developer container configured to be detachably attached to the developing device.

With such a configuration, when the developer container is detached from the mounting portion of the developing device, the driving force transmitter releases interlocking between the conveyor and the agitator.

According to the embodiments, there is provided a process unit configured to be detachably attached to an image forming apparatus main body. The process unit includes a latent image supporting body configured to support a latent image on a surface thereof; and the developing device configured to supply developer to the latent image on the latent image supporting body.

According to the embodiment, there is provided an image forming apparatus including a latent image supporting body;

a developing device configured to supply the developer to a latent image on the latent image supporting body;

the developer container configured to store the developer and configured to supply the developer to the developing device;

a mounting portion formed in the image forming apparatus main body and configured to be mounted on by the developer container; and a main body side drive gear disposed in the image forming apparatus and configured to be driven by a driving source in the image forming apparatus, wherein the sequence of gears engages with the main body side drive gear and is transmitted the driving torque by the main body side drive gear.

According to the embodiment, there is provided an image forming apparatus including a process unit configured to be detachably attached to an image forming apparatus main body, the process unit including a latent image supporting body configured to support a latent image on a surface thereof and a developing device configured to supply developer to the latent image on the latent image supporting body; the developer container configured to store the developer and configured to supply the developer to the developing device; and a main body side drive gear disposed in the image forming apparatus and configured to be driven by a driving source in the image forming apparatus, wherein the sequence of gears engages with the main body side drive gear and is transmitted the driving torque by the main body side drive gear.

The image forming apparatus may further include a first cover disposed in the image forming apparatus and configured to be opened and closed;

a container mounting portion configured to attach and detach the developer container, when the first cover is opened;

a second cover disposed inside the image forming apparatus and configured to be opened and closed, the second cover being disposed below the container mounting portion; and a unit mounting portion configured to attach and detach the process unit, when the second cover is opened, wherein, when the process unit is attached to the unit mounting portion and the second cover is closed, the main body side pushing portion disposed in the process unit is configured to be inserted into the container mounting portion from the second cover.

In the above, the developer container, the developing device, the process unit, and the image forming apparatus have been explained by the embodiments. However, the present invention is not limited to the above-described embodiments, and various modifications and improvements may be made within the scope of the present invention. For example, the number, the shape, and the position of each of the components may be modified without departing from the scope of the present invention.

The invention claimed is:

1. A detachable device to be detachably attached to an image forming apparatus, the detachable device comprising:

a container gear to be driven by a main body gear at a contact position;

a convex portion to insert into an image forming apparatus groove; and a concave portion into which an image forming apparatus protrusion is inserted, wherein, in a direction of a rotational shaft of the container gear, the convex portion is disposed at one side of the contact position, and the concave portion is disposed on the other side.

2. The detachable device according to claim 1, wherein the concave portion is a part of a groove in a vertical direction.

3. The detachable device according to claim 2, wherein the groove includes a container guiding portion to attach the detachable device to the image forming apparatus; and a container positioning portion to position the detachable device with respect to the image forming apparatus, the container positioning portion being above the container guiding portion.

4. The detachable device according to claim 3, wherein a width of the positioning portion is smaller than a width of the container guiding portion.

5. The detachable device according to claim 1, wherein the container gear, the convex portion, and the concave portion are at one end of the detachable device.

6. The detachable device according to claim 1, wherein one end of the detachable device is biased by a biasing member of the image forming apparatus.

7. The detachable device according to claim 1, wherein the convex portion is at a gear cover to store the container gear.

8. The detachable device according to claim 1, wherein the convex portion is to contact a lower end of the image forming apparatus groove.

9. The detachable device according to claim 1, wherein a length from a center of the convex portion to the concave portion is greater than a length from the convex portion to the contact position.

10. The detachable device according to claim 1, wherein toner is stored inside the detachable device.

11. The detachable device according to claim 10, wherein carrier particles are further stored inside the detachable device.

12. The detachable device according to claim 10, wherein the container gear is at an end of a conveyor to convey the toner.

13. The detachable device according to claim 1, wherein the detachable device is to be attached to the image forming apparatus in a vertical direction.

14. A detachable device to be detachably attached to an image forming apparatus, the detachable device comprising:

a container gear to be driven by a main body gear at a contact position;

a convex portion to insert into an image forming apparatus groove; and a concave portion into which an image forming apparatus protrusion is inserted;

wherein the contact position is a position between the convex portion and the concave portion in a direction of a rotational shaft of the container gear.

15. The detachable device according to claim 14, wherein the concave portion is a part of a groove in a vertical direction.

16. The detachable device according to claim 15, wherein the groove includes a container guiding portion to attach the detachable device to the image forming apparatus; and a container positioning portion to position the detachable device with respect to the image forming apparatus, the container positioning portion being above the container guiding portion.

17. The detachable device according to claim 16, wherein a width of the positioning portion is smaller than a width of the container guiding portion.

18. The detachable device according to claim 14, wherein the container gear, the convex portion, and the concave portion are at one end of the detachable device.

19. The detachable device according to claim 14, wherein one end of the detachable device is biased by a biasing member of the image forming apparatus.

20. The detachable device according to 14, wherein the convex portion is at a gear cover to store the container gear.

21. The detachable device according to claim 14, wherein the convex portion is to contact a lower end of the image forming apparatus groove.

22. The detachable device according to claim 14, wherein a length from a center of the convex portion to the concave portion is greater than a length from the convex portion to the contact position.

23. The detachable device according to claim 14, wherein toner is stored inside the detachable device.

24. The detachable device according to claim 23, wherein carrier particles are further stored inside the detachable device.

25. The detachable device according to claim 23, wherein the container gear is at an end of a conveyor to convey the toner.

26. The detachable device according to claim 14, wherein the detachable device is to be attached to the image forming apparatus in a vertical direction.

* * * * *